US008641159B2

(12) United States Patent
Kondo

(10) Patent No.: US 8,641,159 B2
(45) Date of Patent: Feb. 4, 2014

(54) LIQUID EJECTING APPARATUS

(75) Inventor: Takamitsu Kondo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 521 days.

(21) Appl. No.: 12/616,664

(22) Filed: Nov. 11, 2009

(65) Prior Publication Data

US 2010/0118076 A1 May 13, 2010

(30) Foreign Application Priority Data

Nov. 11, 2008 (JP) ..... 2008-289102

(51) Int. Cl.
*B41J 29/38* (2006.01)

(52) U.S. Cl.
USPC ..... 347/14

(58) Field of Classification Search
USPC ..... 347/42, 43, 14
See application file for complete search history.

(56) References Cited

U.S. PATENT DOCUMENTS

| | | | | |
|---|---|---|---|---|
| 6,398,346 | B1 * | 6/2002 | Anderson et al. | 347/57 |
| 6,464,321 | B1 * | 10/2002 | Nunokawa | 347/19 |
| 6,499,822 | B1 * | 12/2002 | Abe et al. | 347/19 |
| 6,692,095 | B1 * | 2/2004 | Marumoto et al. | 347/14 |
| 6,789,870 | B2 * | 9/2004 | Barnes et al. | 347/19 |
| 7,399,045 | B2 * | 7/2008 | Nishida et al. | 347/14 |
| 7,581,804 | B2 * | 9/2009 | Ishimoto et al. | 347/14 |
| 7,726,762 | B2 * | 6/2010 | Otsuki | 347/14 |
| 2005/0099443 | A1 * | 5/2005 | Lapstun et al. | 347/14 |
| 2005/0219293 | A1 * | 10/2005 | Kachi | 347/14 |
| 2009/0244149 | A1 * | 10/2009 | Yamazaki | 347/14 |
| 2013/0241987 | A1 * | 9/2013 | Hatanaka | 347/14 |

FOREIGN PATENT DOCUMENTS

| | | | |
|---|---|---|---|
| JP | 2004-291401 | A | 10/2004 |
| JP | 2005-022383 | A | 1/2005 |
| JP | 3128648 | U | 1/2007 |
| JP | 2008-023982 | A | 2/2008 |
| JP | 2008-149624 | A | 7/2008 |

* cited by examiner

*Primary Examiner* — Charlie Peng
(74) *Attorney, Agent, or Firm* — Kilpatrick Townsend & Stockton LLP

(57) ABSTRACT

Provided is a liquid ejecting apparatus including: a first nozzle array in which a plurality of nozzles for ejecting a liquid is lined up in a predetermined direction; a second nozzle array in which a plurality of nozzles for ejecting a liquid is lined up in the predetermined direction; and a controller which determines whether or not correction is performed based on a ruled-line direction and the number of dots in a ruled-line width direction, when a ruled line is printed by forming dots by the first nozzle array and then forming dots by the second nozzle array.

9 Claims, 15 Drawing Sheets

(DEVIATION AMOUNT: – 50 μm)

(DEVIATION AMOUNT: + 50 μm)

LIQUID EJECTING APPARATUS

This application claims priority to Japanese Patent Application No. 2008-289102, filed Nov. 11, 2008, the entirety of which is incorporated by reference herein.

BACKGROUND

1. Technical Field

The present invention relates to a liquid ejecting apparatus.

2. Related Art

There is a liquid ejecting apparatus including a nozzle array (hereinafter, referred to as a first nozzle array), in which the nozzles line up in a paper width direction, and a nozzle array (hereinafter, referred to as a second nozzle array), in which the nozzles line up in the paper width direction at the downstream side of the first nozzle array in a transportation direction, and printing an image by using the two nozzle arrays (for example, see JP-A-2008-149624). In such a liquid ejecting apparatus, the nozzles of the first nozzle array and the nozzles of the second nozzle array are arranged in a zigzag shape and dots are formed by the second nozzle array between the dots formed by the first nozzle array, thereby increasing the resolution of printing.

However, when printing is performed by the first nozzle array and the second nozzle array, the landing positions of the ink ejected from the nozzle arrays may be shifted due to shrinkage of a medium. In particular, if a deviation occurs when a ruled line is printed, the ruled line may be divided.

SUMMARY

An advantage of some aspects of the invention is that it prevent deterioration of image quality when a ruled line is printed.

According to an aspect of the invention, there is provided a liquid ejecting apparatus including: a first nozzle array in which a plurality of nozzles for ejecting a liquid is lined up in a predetermined direction; a second nozzle array in which a plurality of nozzles for ejecting a liquid is lined up in the predetermined direction; and a controller which determines whether or not correction is performed based on a ruled-line direction and the number of dots in a ruled-line width direction, when a ruled line is printed by forming dots by the first nozzle array and then forming dots by the second nozzle array.

The other features of the invention will become apparent by the present specification and the accompanying drawings.

BRIEF DESCRIPTION OF THE DRAWINGS

The invention will be described with reference to the accompanying drawings, wherein like numbers reference like elements.

FIGS. 8A and 8B are views showing sample images in the case where a deviation occurs in a paper width direction when printing is performed by two heads, wherein FIG. 8A is a view when the deviation of the paper width direction is 50 μm in a minus direction and FIG. 8B is a view when the deviation of the paper width direction is 50 μm in a plus direction.

FIGS. 16A and 16B are examples of a ruled-line pattern, wherein FIG. 16A shows a ruled-line pattern in a paper width direction, and FIG. 16B shows a ruled-line patter in a transportation direction.

DESCRIPTION OF EXEMPLARY EMBODIMENTS

Outline of Disclosure

Figure 1:
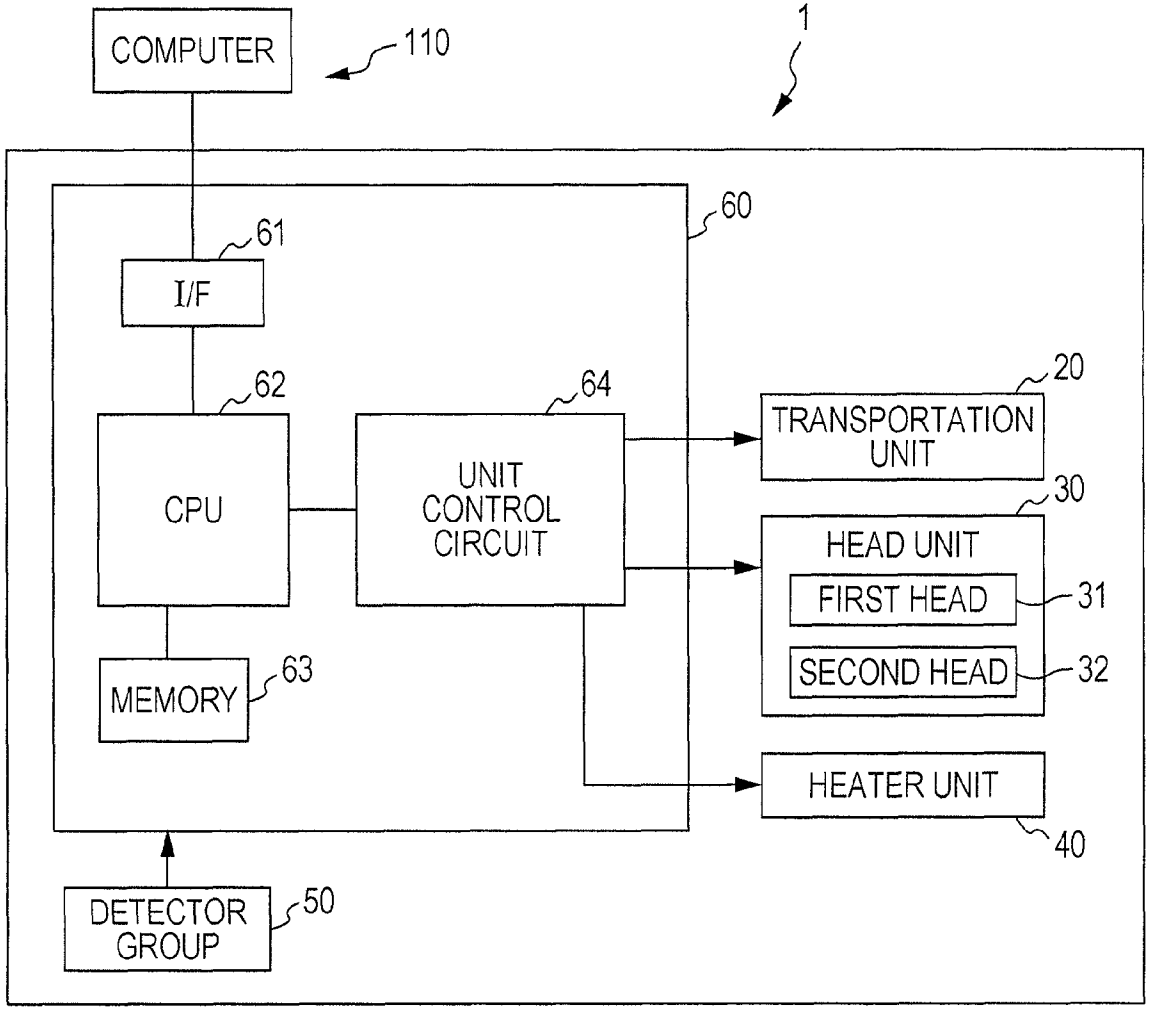
FIG. 1 is a block diagram showing the overall configuration of a printer according to the present embodiment.

At least the following will become apparent by the present specification and the accompanying drawings.

A liquid ejecting apparatus including: a first nozzle array in which a plurality of nozzles for ejecting a liquid is lined up in a predetermined direction; a second nozzle array in which a plurality of nozzles for ejecting a liquid is lined up in the predetermined direction; and a controller which determines whether or not correction is performed based on a ruled-line direction and the number of dots in a ruled-line width direction, when a ruled line is printed by forming dots by the first nozzle array and then forming dots by the second nozzle array will become apparent.

According to such a liquid ejecting device, it is possible to prevent deterioration of image quality when a ruled line is printed.

In the liquid ejecting apparatus, the correction may enlarge the size of the dots formed by one of the nozzle arrays and disable the other nozzle arrays so as to not form the dots.

According to such a liquid ejecting device, it is possible to print a ruled line close to a ruled line printed using two nozzle arrays without being divided. Accordingly, it is possible to prevent deterioration of image quality.

In the liquid ejecting device, one of the nozzle arrays may be the first nozzle array and the other of the nozzle arrays may be the second nozzle array.

According to such a liquid ejecting device, it is possible to lengthen the drying time of the printed ruled line.

In the liquid ejecting apparatus, the correction may adjust the ejection of the liquid from at least one of the first nozzle array and the second nozzle array.

According to such a liquid ejecting device, it is possible to print the ruled line without dividing the ruled line.

In the liquid ejecting apparatus, if the ruled line is the ruled line of the predetermined direction, in which the number of dots in the ruled-line width direction which are formed using the nozzles of the first nozzle array and the nozzles of the second nozzle array is one, the controller may perform the correction by changing the ejection timing of the liquid from the second nozzle array or the first nozzle array.

According to such a liquid ejecting apparatus, it is possible to adjust the positions of the predetermined direction of the dots formed by one of the nozzle arrays. Accordingly, it is possible to print the ruled line of the predetermined direction, in which the number of dots of the ruled-line width direction is one, without being divided.

In the liquid ejecting apparatus, if the ruled line is the ruled line of the direction crossing the predetermined direction, in which the number of dots in the ruled-line width direction which are formed using some nozzles of the first nozzle array and some nozzles of the second nozzle array is two, the controller may perform the correction by changing the nozzles of the second nozzle array or the nozzles of the first nozzle array used for forming the ruled line.

According to such a liquid ejecting apparatus, it is possible to adjust the positions (positions of the direction crossing the predetermined direction) of the dots formed by one of the nozzle arrays. Accordingly, it is possible to print the ruled line of the direction crossing the predetermined direction, in which the number of dots of the ruled-line width direction is two, without being divided.

In the liquid ejecting apparatus, the controller determines whether or not the correction is performed, based on the position on the medium, the ruled-line direction, and the number of dots in the ruled-line width direction.

According to such a liquid ejecting apparatus, it is possible to perform the correction without dividing the ruled line, even when a deviation direction is changed according to the position on the medium, that is, even when the medium has shrunk.

In the liquid ejecting apparatus, test patterns, which are configured from a plurality of ruled lines formed with different numbers of dots in the width direction and formed in the predetermined direction and the direction crossing the predetermined direction, may be printed in a plurality of regions on the medium, and the position on the medium in which the correction is performed may be determined based on the result of printing of the test patterns.

According to such a liquid ejecting apparatus, it is possible to perform the correction of the ruled line with certainty according to the position on the medium.

Hereinafter, the embodiment of the invention will be described using a printer 1 (line head printer) which is one of a liquid ejecting apparatus.

Configuration of Printer

Figure 2A:
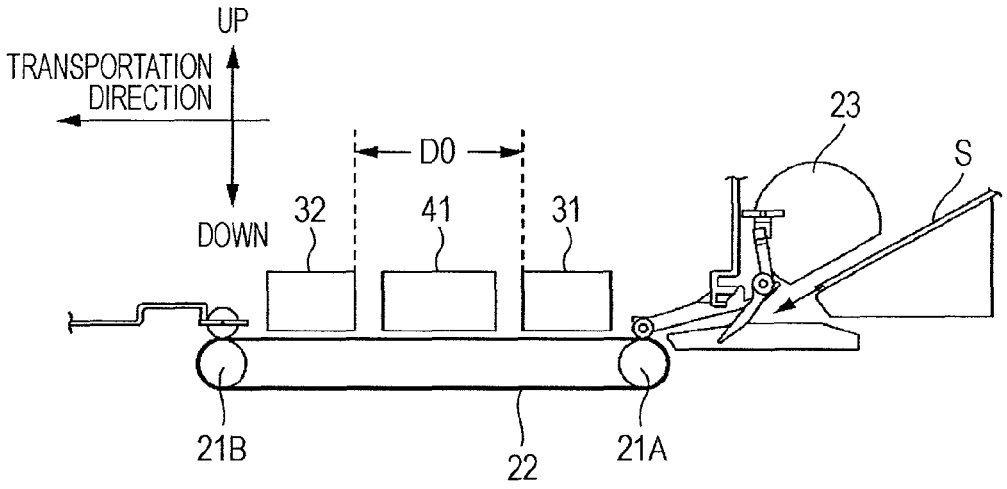
FIG. 2A is a cross-sectional view of the printer.
Figure 2B:
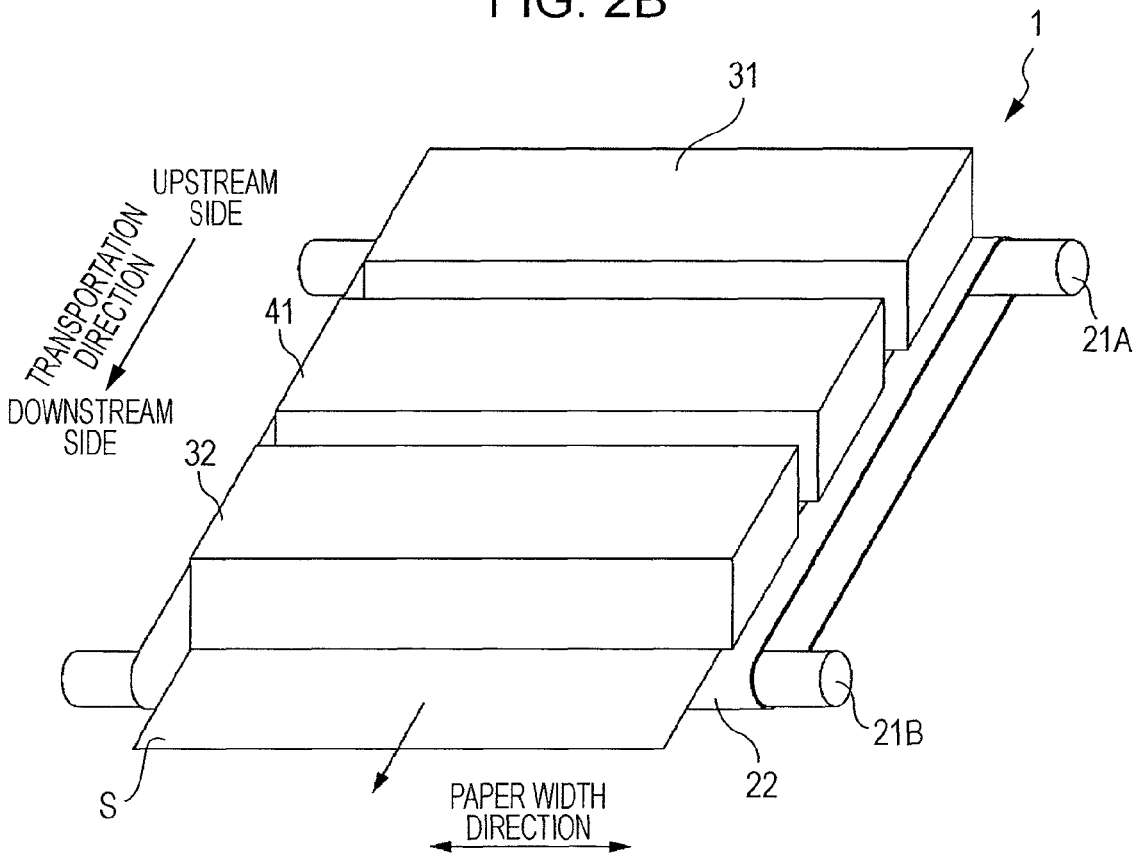
FIG. 2B is a view showing a state in which the printer transports paper.

FIG. 1 is a block diagram showing the overall configuration of a printer 1. FIG. 2A is a cross-sectional view of the printer 1, FIG. 2B is a view showing a state in which the printer 1 transports paper S (medium).

The printer 1 includes a controller 60, a transportation unit 20, a head unit 30, a heater unit 40, and a detector group 50. The printer 1, which receives print data from a computer 110 functioning as an external device, controls the units (the transportation unit 20, the head unit 30 and the heater unit 40) by using a controller 60 and prints an image on the paper S. The detector group 50 monitors the state of the printer 1 and the controller 60 controls the units based on the detection result.

The controller 60 is a control unit for controlling the printer 1. An interface unit 61 transmits or receives data between the computer 110 functioning as the external device and the printer 1. A CPU 62 is an arithmetic processing unit for controlling the overall printer 1. A memory 63 secures an area for storing the program of the CPU 62 or a working area. The CPU 62 controls the units by a unit control circuit 64 according to the program stored in the memory 63.

The transportation unit 20 feeds the paper S to a printable position and transports the paper S at a predetermined transportation speed in a transportation direction during printing. A paper feed roller 23 is a roller for automatically feeding the paper S inserted into a paper inserting port onto a transportation belt 22 in the printer 1. A ring-shaped transportation belt 22 is rotated by transportation rollers 21A and 21B and the paper S on the transportation belt 22 is transported in the transportation direction. The paper S is electrostatically sucked or vacuum-sucked to the transportation belt 22 (not shown).

The head unit 30 ejects ink onto the paper S and includes a plurality of heads. In the present embodiment, the head unit 30 has two heads (a first head 31 and a second head 32), and these heads line up from an upstream side to a downstream side of the transportation direction in the order of the first head 31 and the second head 32. In addition, on the lower surface of each of the heads, a plurality of nozzles for ejecting ink is provided. The relationship between each of the heads and the nozzles will be described later.

The heater unit 40 has a drying mechanism 41. The drying mechanism 41 is provided between the first head 31 and the second head 32. The drying mechanism 41 heats the paper S at 40 to 50° C. before the printing of the paper S is performed by the second head 32 so as to accelerate the drying of the paper S printed by the first head 31.

The detector group 50 monitors the state of the printer 1, and includes, for example, a rotary encoder, which is mounted in the transportation roller 21A and is used for control such as the transportation of the paper, a paper detection sensor for detecting the presence/absence of the transported paper S, and the like.

About the Head

Figure 3:
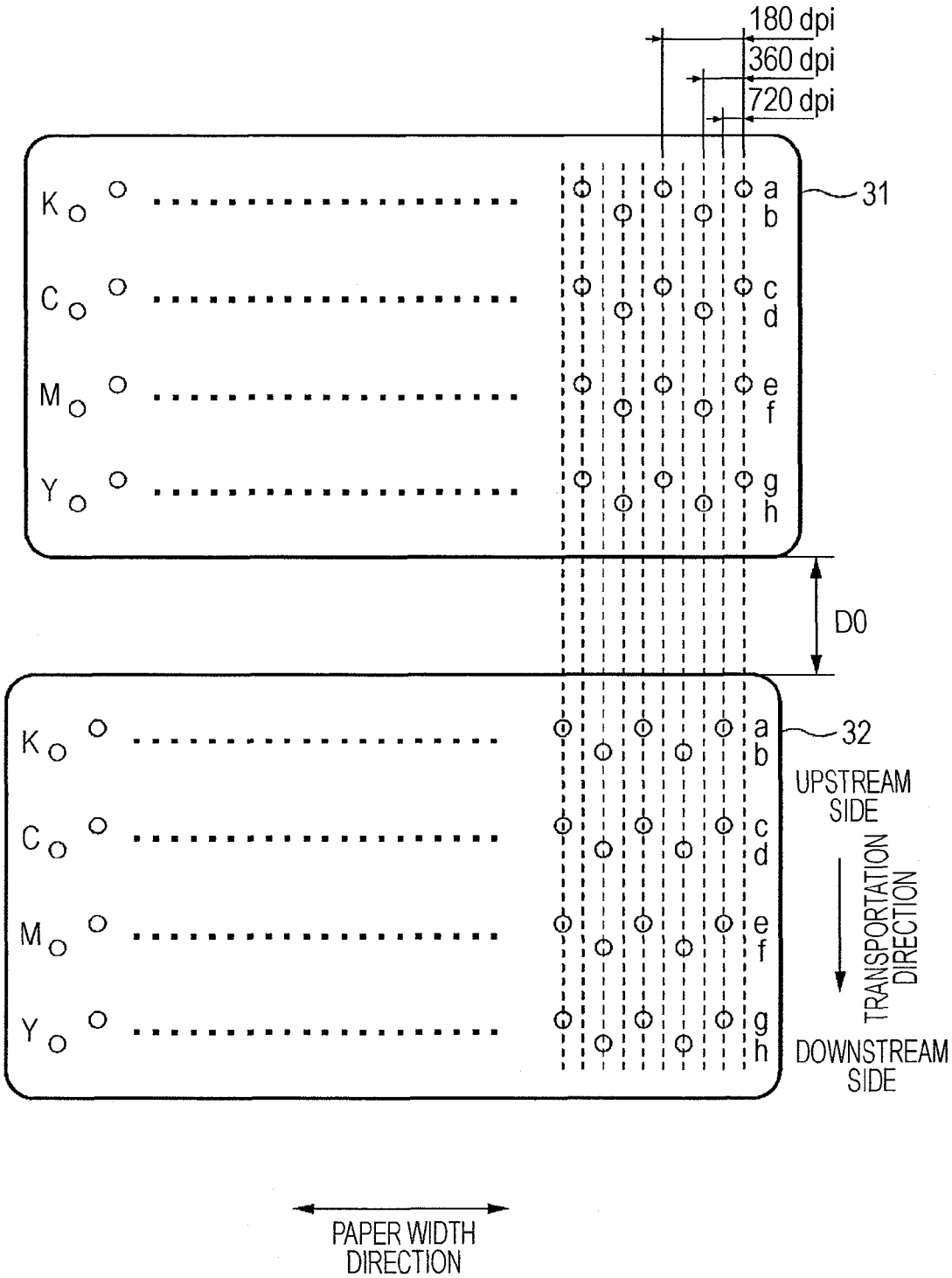
FIG. 3 is a view showing the nozzle arrangement of a first head 31 and a second head 32.

FIG. 3 is a view showing the nozzle arrangement of the first head 31 and the second head 32. In the drawing, the nozzle arrangement when viewed from above the printer is shown. Originally, the nozzles which are present in the lower surface of the head cannot be viewed from above the printer by the other elements. However, herein, in order to facilitate description, the position where the nozzles are present is perspectively shown when viewed from above the printer.

The first head 31 and the second head 32 are full line type heads which continuously line up in a length equal to or more than the width of paper in the width direction (hereinafter, also referred to as the paper width direction) of the paper from one end to the other end of the nozzles of the nozzle arrays. The first head 31 and the second head 32 of a reference example described herein are shown to be shorter than the actual size in the paper width direction for convenience of a space. The first head 31 and the second head 32 can eject ink droplets in the whole width of the paper.

In the drawing, the first head 31 is arranged at the upstream side of the transportation direction of the paper and the second head 32 is arranged at the downstream side of the transportation direction. Both the first head 31 and the second head 32 have the same nozzle arrangement.

The first head 31 includes eight nozzle arrays from a nozzle array a to a nozzle array h. The nozzle arrays of the first head correspond to a first nozzle array. The nozzle array a and the nozzle array b are a black ink nozzle group for ejecting black (K) ink droplets. The nozzle array c and the nozzle array d are a cyan ink nozzle group for ejecting cyan (C) ink droplets. The nozzle array e and the nozzle array f are a magenta ink nozzle group for ejecting magenta (M) ink droplets. The nozzle array g and the nozzle array h are a yellow ink nozzle group for ejecting yellow (Y) ink droplets. Each of the nozzle groups of the respective colors includes two nozzle arrays.

In each of the nozzle arrays a to h, the nozzles are formed with a pitch of 180 dpi. The two nozzle arrays of each of the nozzle groups are formed so as to deviate by 360 dpi in the paper width direction. As a result, for example, the nozzles of the nozzle array b are arranged between the nozzles of the nozzle array a in the paper width direction.

Similarly, the nozzles of the nozzle array d are arranged between the nozzles of the nozzle array c so as to deviate by 360 dpi in the paper width direction. The nozzles of the nozzle array f are arranged between the nozzles of the nozzle array e so as to deviate by 360 dpi in the paper width direction. The nozzles of the nozzle array h are arranged between the nozzles of the nozzle array g so as to deviate by 360 dpi in the paper width direction.

The second head 32 also includes eight nozzle arrays from a nozzle array a to a nozzle array h. In addition, the nozzle arrays of the second head correspond to a second nozzle array. As described above, the arrangement of the nozzles of the second head 32 is equal to the arrangement of the nozzles of the first head 31. However, the second head 32 is fixed to the printer 1 so as to deviate from the first head 31 by 720 dpi in the paper width direction (the direction perpendicular to the transportation direction of the paper).

In this way, the nozzles of the black ink nozzle group of the second head 32 are positioned between the nozzles of the black ink nozzle group of the first head 31 in the paper width direction. Accordingly, ink droplets can land on the paper in the paper width direction with resolution of 720 dpi.

Similarly, the nozzles of the cyan ink nozzle group of the second head 32 are positioned between the nozzles of the cyan ink nozzle group of the first head 31. In addition, the nozzles of the magenta ink nozzle group of the second head 32 are positioned between the nozzles of the magenta ink nozzle group of the first head 31. In addition, the nozzles of the yellow ink nozzle group of the second head 32 are positioned between the nozzles of the yellow ink nozzle group of the first head 31. The ink droplets of the respective ink colors can land on the paper in the paper width direction with resolution of 720 dpi.

Although FIG. 3 shows only the first head 31 and the second head 32, the first head 31 and the second head 32 are fixed to the printer 1 at an interval D0 with the drying mechanism 41 interposed therebetween, as shown in FIGS. 2A and 2B.

When the paper S is transported in the transportation direction and ink droplets are ejected from the nozzles, the ink droplets land along the transportation direction. At this time, since the nozzles of the nozzle array a, the nozzle array c, the nozzle array e and the nozzle g of the first head line up at positions overlapping with each other when viewed from the transportation direction, the ink droplets are ejected onto the same raster line. Such a relationship is the same for the case of the nozzle array b, the nozzle array d, the nozzle array f and the nozzle array h. The same is true in the nozzles of the second head 32.

By ejecting the ink droplets of the respective ink colors on the same raster line, the ink colors land on the paper so as to overlap with each other.

Figure 4A:
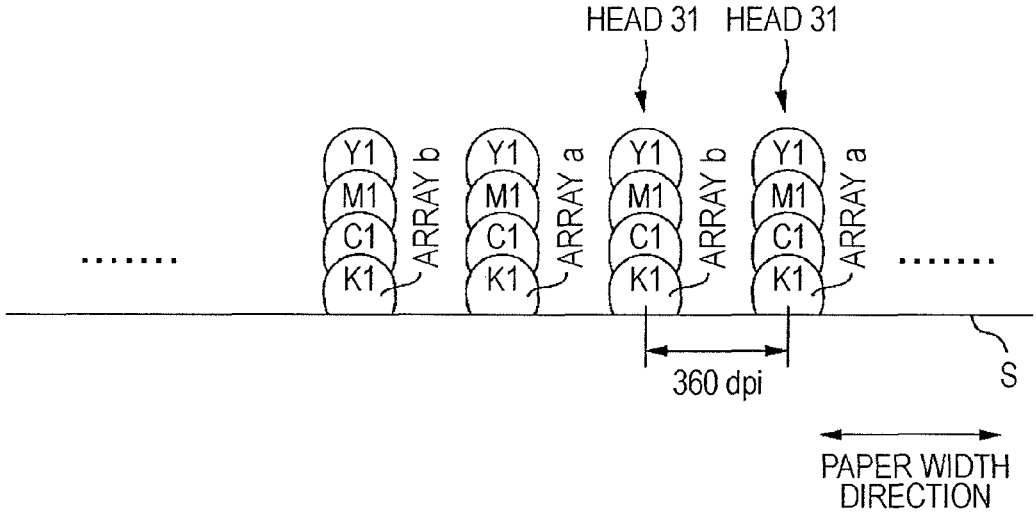
FIG. 4A is a view showing a state in which ink droplets from the first head 31 land on paper.
Figure 4B:
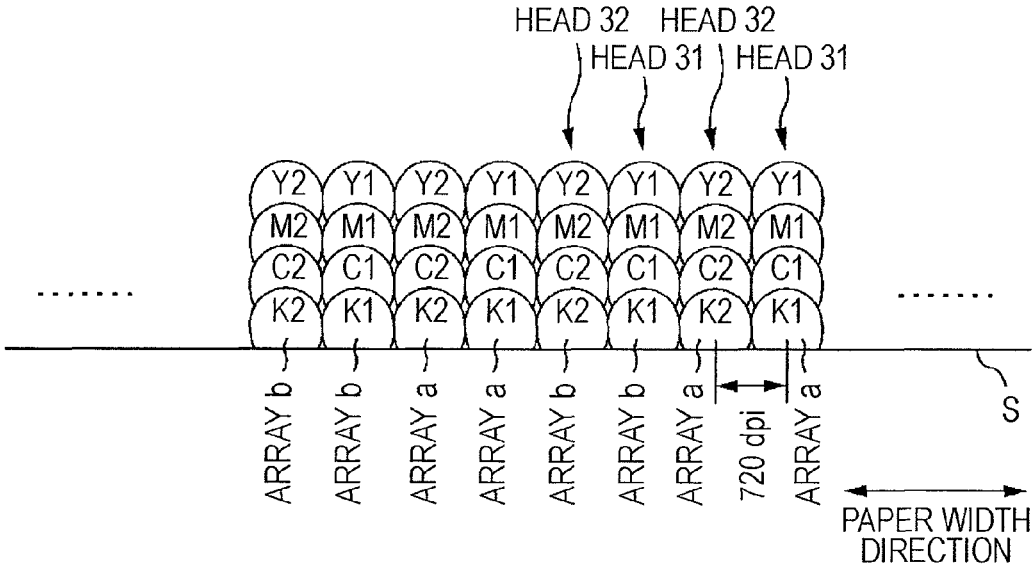
FIG. 4B is a view showing a state in which ink droplets from the first head 31 and the second head 32 land on paper.

FIG. 4A is a view showing a state in which ink droplets from the first head 31 land on the paper, and FIG. 4B is a view showing a state in which ink droplets from the first head 31 and the second head 32 land on the paper. In these drawings, the transverse direction of the paper S is the paper width direction of each of the heads. In the drawings, the state is shown in which the ink droplets overlap with each other in the order of the ink droplets landing on the paper S. As shown in the drawings, the ink droplets land in the order of black (K), cyan (C), magenta (M) and yellow (Y).

In the drawings, the number postfixed to the reference numeral indicating the ink color is the number of the ejected head. For example, "K1" denotes the black ink K ejected from the first head 31 and "C2" denotes the cyan ink C ejected from the second head 32.

With respect to the ink colors of the first head 31, the interval between the nozzles in the paper width direction was 360 dpi. In the first head 31, the positions of the nozzles of the respective ink colors were coincident with each other in the paper width direction (arranged such that the nozzles of the respective colors overlap with each other when viewed from the transportation direction). Accordingly, when the ink droplets are ejected from all the nozzles of the first head 31, the ink droplets land in the paper width direction with resolution of 360 dpi. For example, "K1" of the right end of FIG. 4A is a dot formed by the nozzles of the array a of the first head 31, and left adjacent "K1" thereof is a dot formed by the nozzles of the array b of the first head 31. In FIG. 3, the interval between the dot formed by the nozzles of the array a and the dot formed by the nozzles of the array b is 360 dpi.

While the paper S is transported in the transportation direction, the ink droplets are ejected in each pixel of the paper S in the order of black (K), cyan (C), magenta (M) and yellow (Y). Accordingly, as shown in FIG. 4A, the ink droplets land on the paper S in the order of black (K), cyan (C), magenta (M) and yellow (Y).

The second head 32 is arranged so as to deviate from the nozzles of the first head 31 by 720 dpi in the paper width direction. Accordingly, as shown in FIG. 4B, the ink droplets from the second head 32 land so as to deviate from the landing positions of the ink droplets from the first head 31 by 720 dpi in the paper width direction. That is, dots are formed by the second head 32 between the dot and the dot formed by the first head 31. For example, in the drawing, for example, the second dot "K2" from the right end is the dot formed by the nozzle of the array a of the second head 32 and the dot "K2" separated therefrom by two columns on the left side thereof is the dot formed by the nozzle of the array b of the second head 32. Similar to the first head 31, even in the second head 32, the interval between the dots formed by the nozzles of the array a and the dots formed by the nozzles of the array b is 360 dpi. Since the dots are formed by the second head 32 between the dots formed by the first head 31, the interval between the dots in the paper width direction is 720 dpi.

As can be seen from the drawing, raster lines are alternately printed by the first head 31 and the second head 32 in the paper width direction. In the present embodiment, the first head 31 forms odd-numbered raster lines and the second head 32 forms even-numbered raster lines.

In the following embodiments, description will be given using one (for example, the black ink nozzle group) of the nozzle groups of the four colors of each of the heads.

About the Printing Order

When a print instruction and print data are received from the computer 110, the controller 60 analyzes the contents of various commands included in the print data and performs the following process using the units.

First, the controller 60 rotates the paper feed roller 23 so as to feed the paper S to be printed onto the transportation belt 22. Then, the controller 60 rotates the transportation belt 22 by using the transportation rollers 21A and 21B. By rotating the transportation belt 22, the fed paper S is transported on the transportation belt 22 at a predetermined speed without stopping and sequentially passes below the first head 31, the drying mechanism 41, and the second head 32. While the paper S passes below the heads, the inks are intermittently ejected from the nozzles of the heads due to the instruction of the controller 60. As a result, dot arrays composed of a plurality of dots are formed on the paper S along the transportation direction and the paper width direction. Finally, the controller 60 ejects the paper S on which an image is printed.

First Embodiment

As described above, in the printer 1, print resolution is increased by forming the dots by the nozzle arrays of the second head 32 between the dots formed by the nozzle arrays of the first head 31.

If printing is performed using two heads (the first head 31 and the second head 32), it is preferable that the paper S printed by the first head 31 has been dried when printing is performed by the second head 32 of the rear end (the transportation direction downstream side) in terms of the prevention of smearing between the dots. Accordingly, in the present embodiment, the drying mechanism 41 is provided between the first head 31 and the second head 32 and the drying mechanism 41 accelerates the drying of the paper S. Therefore, it is possible to shorten the interval D0 between the first head 31 and the second head 32 and shorten the printing time.

However, by drying the paper S, the paper S may be shrunk due to the evaporation of moisture. When the paper S has shrunk, the formation positions of the dots (the landing positions of the inks) from the first nozzle array and the second nozzle array are deviated from each other and thus image quality deteriorates. This problem particularly is severe when a thin ruled line is printed. For example, when one ruled line is printed, two ruled lines may be formed.

For example, the same problem occurs even when the positions (mounting positions) of the heads deviate or even when the ejection directions of the inks from the heads deviate.

About the Relationship between Thickness of Ruled line and Deviation

First, the relationship between the thickness of a ruled line and deviation when the ruled line is printed using two heads (nozzle arrays) will be described with reference to the drawings. The diameter of the dot used in the present embodiment is 70 μm, and resolution thereof is 720 dpi in the paper width direction and is 1440 dpi in the transportation direction. The following drawings show the case where the deviation of the landing positions of the inks by the second head 32 from the first head 31 is zero (no deviation), 50 μm (plus side and minus side), and 75 μm (plus side and minus side). In the deviation of the transportation direction, the downstream side of the transportation direction is set to the plus side and the upstream side thereof is set to the minus side. In addition, in the deviation of the paper width direction, in FIG. 3, a direction (the left direction of FIG. 3), where there is further deviation of the second head 32 from the first head 31 in FIG. 3, is set as the plus side and the opposite side thereof is set as the minus side. In the following description, a ruled line in which the number of dots in a ruled-line width direction is one is called a 1-dot ruled line, a ruled line in which the number of dots in the ruled-line width direction is two is called a 2-dot ruled line, and a ruled line in which the number of dots in the ruled-line width direction is three is called a 3-dot ruled line.

1-Dot Ruled Line

Figure 5:
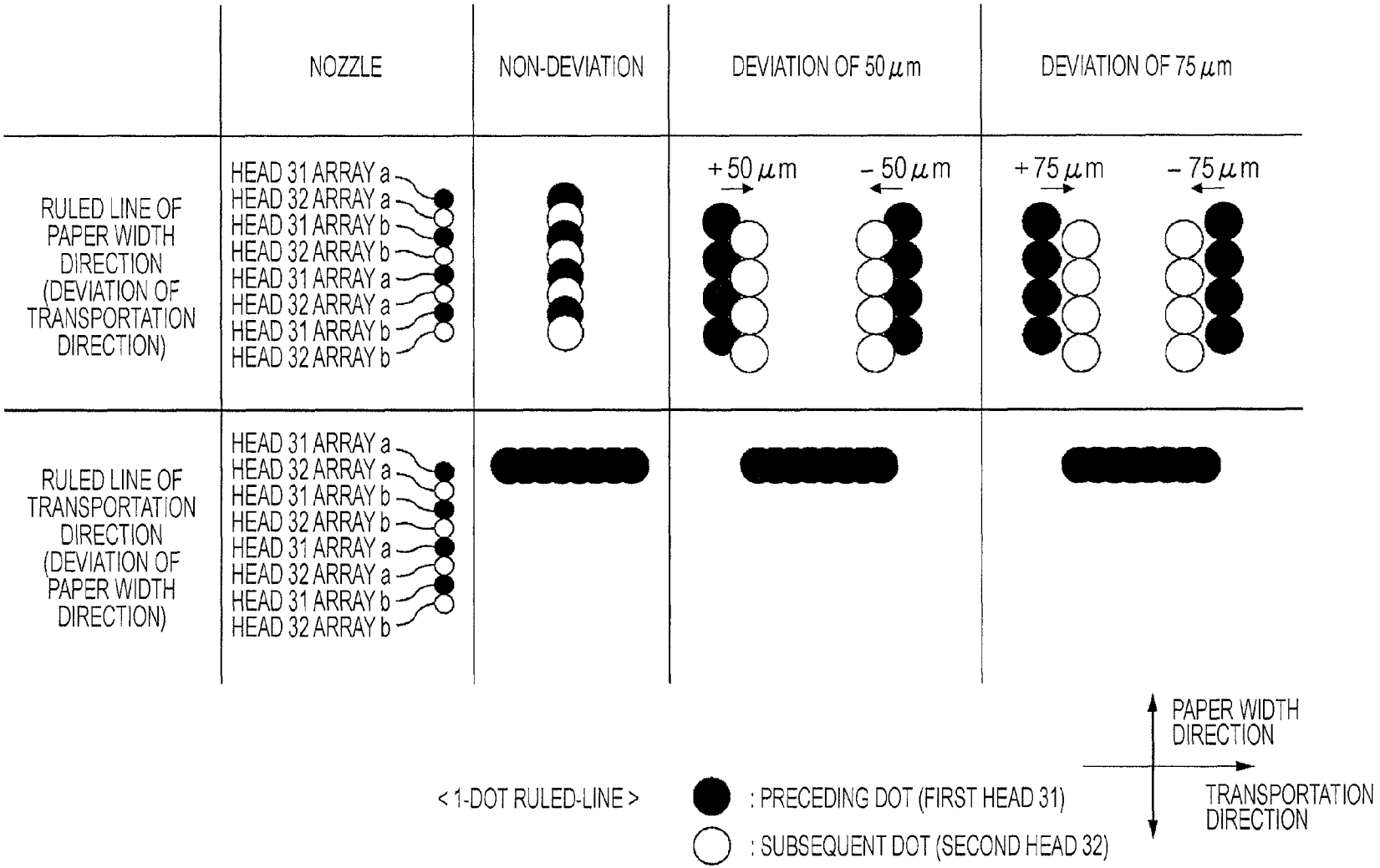
FIG. 5 is a view explaining the influence of a deviation of a 1-dot ruled line.

FIG. 5 is a view explaining the influence of a deviation of a 1-dot ruled line.

In the drawings, a preceding dot (a dot formed by each of the nozzles of the first head 31) is denoted by a black circle and a subsequent dot (a dot formed by each of the nozzles of the second head 32) is denoted by a white circle.

The upper side of the drawing shows the case where the ruled line of the paper width direction is printed, and the deviation amount of the transportation direction is sequentially set to zero, 50 μm and 75 μm from the left side of the drawing. In each case, the formation positions of the subsequent dots (landing positions of the inks) are deviated in the plus side and the minus side of the transportation direction.

The lower side of the drawing shows the case where the ruled line of the transportation direction is printed, and the deviation amount of the paper width direction is sequentially set to zero, 50 μm and 75 μm from the left side of the drawing. In each case, the formation positions of the subsequent dots (landing positions of the inks) are deviated in the plus side and the minus side of the paper width direction.

The positions of the nozzles of the heads corresponding to the dots are shown on the left sides of the drawings. For example, in the ruled line of the paper width direction, the uppermost dots of the drawing are formed by the nozzles of the array a of the first head 31, the lower dots thereof are formed by the nozzles of the array a of the second head 32, and the further lower dots thereof are formed by the nozzles of the array b of the first head 31.

As shown in the drawing, if the 1-dot ruled line is printed in the paper width direction, one ruled line is formed when the deviation amount is 50 μm and the ruled line is divided into two ruled lines when the deviation amount is 75 μm.

Meanwhile, if the 1-dot ruled line is printed in the transportation direction, only one nozzle of one head (the nozzle of the array a of the first head 31 in the drawing) is used. Accordingly, one ruled line is formed regardless of the deviation of the landing positions of the inks of the two heads.

In the 1-dot ruled line, the degree of deterioration of image quality changes due to the direction of the ruled line. In more detail, if the 1-dot ruled line is printed in the paper width direction, image quality may deteriorate. In contrast, if the 1-dot ruled line is printed in the transportation direction, image quality does not deteriorate.

2-Dot Ruled Line

Figure 6:
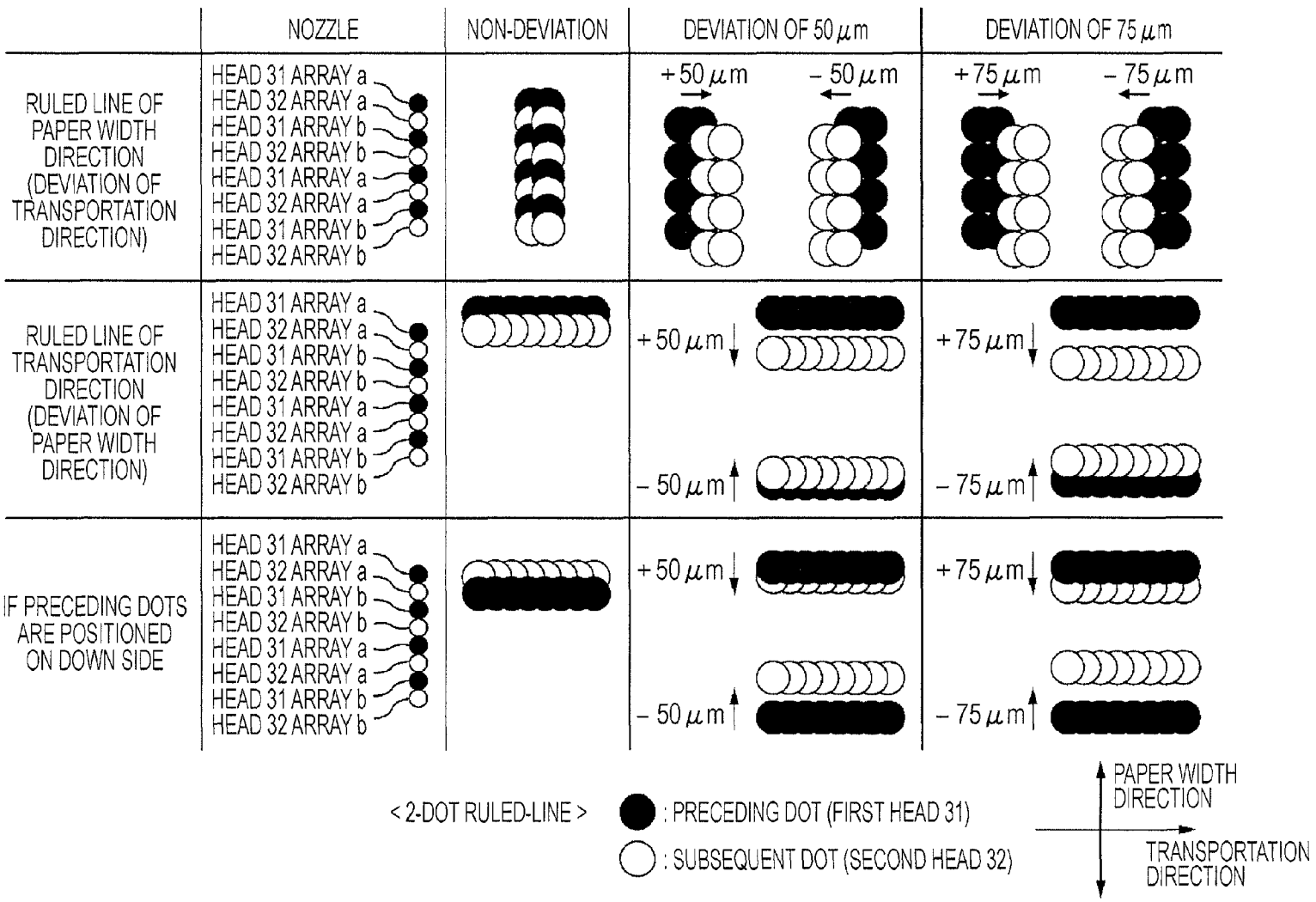
FIG. 6 is a view explaining the influence of a deviation of a 2-dot ruled line.

FIG. 6 is a view explaining the influence of a deviation of a 2-dot ruled line.

The upper side of the drawing shows the case where the ruled line of the paper width direction is printed, and the deviation amount of the transportation direction is sequentially set to zero, 50 μm and 75 μm from the left side of the drawing. Even in this case, similar to the 1-dot ruled line, the formation positions of the subsequent dots (landing positions of the inks) are deviated in the plus side and the minus side of the transportation direction.

The intermediate side and the lower side of the drawing show the case where the ruled line of the transportation direction is printed.

The intermediate side shows the case where the preceding dots are formed on the upper side and the subsequent dots are formed on the lower side. That is, the 2-dot ruled line in which the dots are formed by the first head 31 on the upper side and the dots are formed by the second head 32 on the lower side. For example, in the drawing, when there is no deviation, the upper dots (black) are first formed by the nozzles of the array a of the first head 31 and the lower dots (white) are formed by the nozzles of the array a of the second head 32.

The lower side of the drawing shows the case where the upper and lower positions of the preceding dots and the subsequent dots are opposite to each other. That is, the 2-dot ruled line in which the dots are formed by the first head 31 on the lower side and the dots are formed by the second head 32 on the upper side is shown. For example, in the drawing, when there is no deviation, the lower dots (black) are first formed by the nozzles of the array b of the first head 31 and the upper dots (white) are formed by the nozzles of the array a of the second head 32.

In the drawings, the deviation amount of the paper width direction is sequentially set to zero, 50 μm and 75 μm from the left side of the drawing. Even in this case, similar to the 1-dot ruled line, the formation positions of the subsequent dots (landing positions of the inks) are deviated in the plus side and the minus side of the paper width direction.

As shown in the drawing, if the 2-dot ruled line is printed in the paper width direction, one ruled line is formed even when the deviation amount of the transportation direction is 75 μm. That is, if the 2-dot ruled line is printed in the paper width direction, it is not affected by the influence of the deviation of the transportation direction.

In the ruled line of the transportation direction in which the preceding dots are positioned on the upper side of the subsequent dots (the intermediate side of the drawing), if the deviation of the paper width direction is the minus direction, (although the positions of the dots formed by the heads are opposite to each other) one ruled line is formed. However, if the deviation amount is the plus direction (50 μm and 75 μm), the ruled line is divided into two ruled lines.

In the ruled line of the transportation direction in which the preceding dots are positioned on the lower side of the subsequent dots (the lower side of the drawing), if the deviation of the paper width direction is the plus direction, (although the positions of the dots formed by the heads are opposite to each other) one ruled line is formed. However, if the deviation amount is the minus direction (50 μm and 75 μm), the ruled line is divided into two ruled lines.

In the 2-dot ruled line, the degree of deterioration of image quality changes due to the direction of the ruled line and the direction of the deviation. In detail, in the ruled line of the transportation direction, if the upper ruled line is printed by the preceding dots, the subsequent dots are deviated in the plus direction of the paper width direction and thus image quality may deteriorate. In the ruled line of the transportation direction, if the lower ruled line is printed by the preceding dots, the subsequent dots are deviated in the minus direction of the paper width direction and thus image quality may deteriorate.

Meanwhile, if the ruled line of the paper width direction is printed, even when the subsequent dots are deviated by 75 μm in the plus side and the minus side of the transportation direction, the ruled line is not divided into two ruled lines. Accordingly, even when the deviation of the transportation direction occurs, it is unlikely that image quality will deteriorate.

3-Dot Ruled Line

Figure 7:
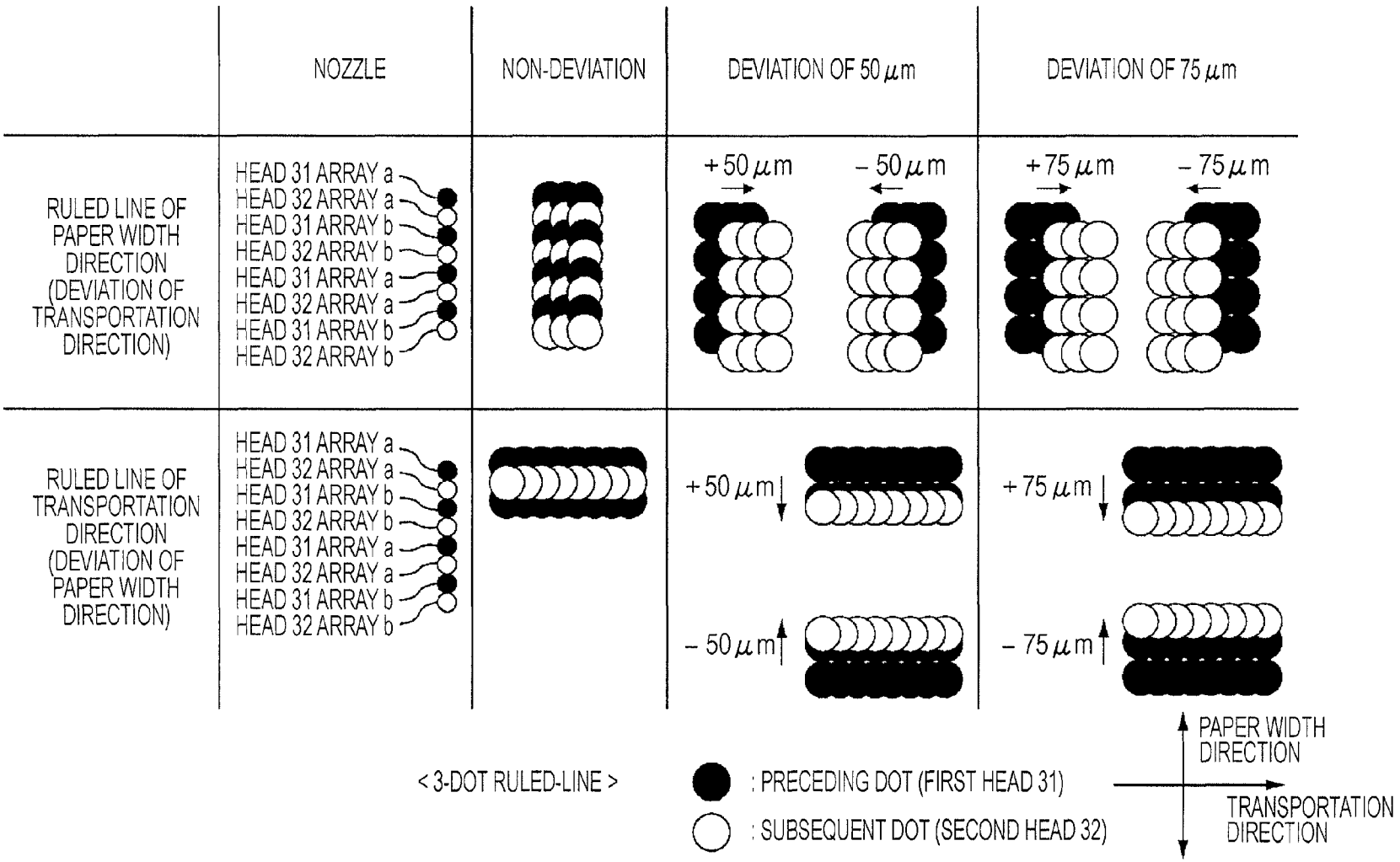
FIG. 7 is a view explaining the influence of a deviation of a 3-dot ruled line.

FIG. 7 is a view explaining the influence of a deviation of a 3-dot ruled line.

In addition, the notation of the drawing is the same as those of the above-described 1-dot ruled line and the 2-dot ruled line and thus the description thereof will be omitted.

In the 3-dot ruled line, even when the deviation amount is 75 μm in both the transportation direction and the paper width direction, one ruled line is formed without being divided. This is because the influence of the deviation amount on the thickness of the ruled line is decreased. Accordingly, if the number of dots of the ruled-line width direction is larger than that of the 3-dot ruled line (in the case of the thick ruled line), the width of the ruled line is only increased and there is hardly any dividing of the ruled line even when a deviation occurs.

About the Influence of Division of Ruled Line on Image Quality

As described above, a thin ruled line is divided by the deviation of the landing positions of the inks from the nozzle arrays of the two heads. In the present embodiment, in the 1-dot ruled line and the 2-dot ruled line, the ruled line is divided into two ruled lines. In the 1-dot ruled line, if a deviation of the transportation direction occurs when the ruled line of the paper width direction is printed, the ruled line is divided. In the 2-dot ruled line, if a deviation occurs in one side of the paper width direction when the ruled line of the transportation direction is printed, the ruled line is divided. If the ruled line is divided, it is possible to visually confirm deterioration of image quality.

Figure 8A:
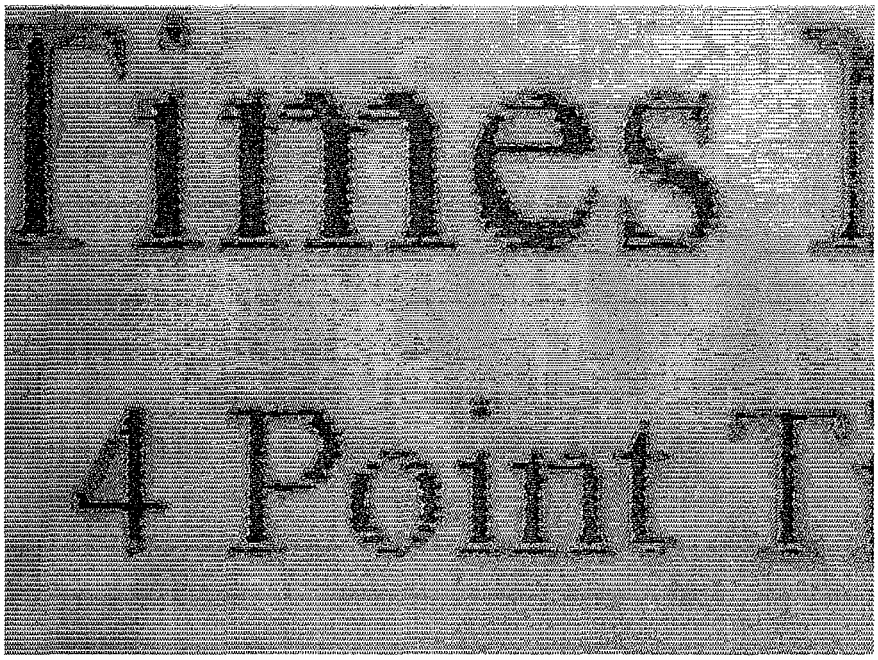
Figure 8B:
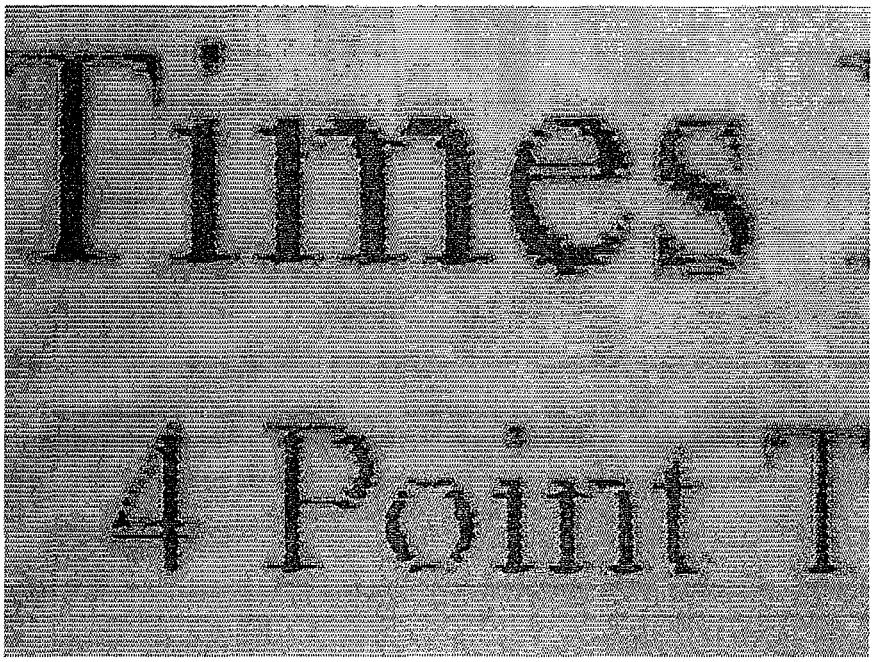

FIGS. 8A and 8B are views showing sample images in the case where a deviation occurs in a paper width direction when printing is performed by two heads, wherein FIG. 8A is a view when the deviation of the paper width direction is 50 μm in a minus direction and FIG. 8B is a view when the deviation of the paper width direction is 50 μm in a plus direction.

In FIGS. 8A and 8B, the transverse line of a small letter e and the lateral line of a numeral 4 are printed by a 2-dot ruled line.

When FIGS. 8A and 8B are compared, the lateral line of e is composed of one line in FIG. 8A (the deviation amount is −50 μm), but is divided into two lines in FIG. 8B (the deviation amount is +50 μm). The lateral line of the numeral 4 is composed of one line in FIG. 8A and is divided into two lines in FIG. 8B. The ruled line is divided such that image quality deteriorates.

In the following embodiment, correction is performed during printing such that the ruled line (the 2-dot ruled line of the transportation direction and the 1-dot ruled line of the paper width direction) which is divided in FIGS. 5 and 6 is not divided.

About the Printing Process

Figure 9:
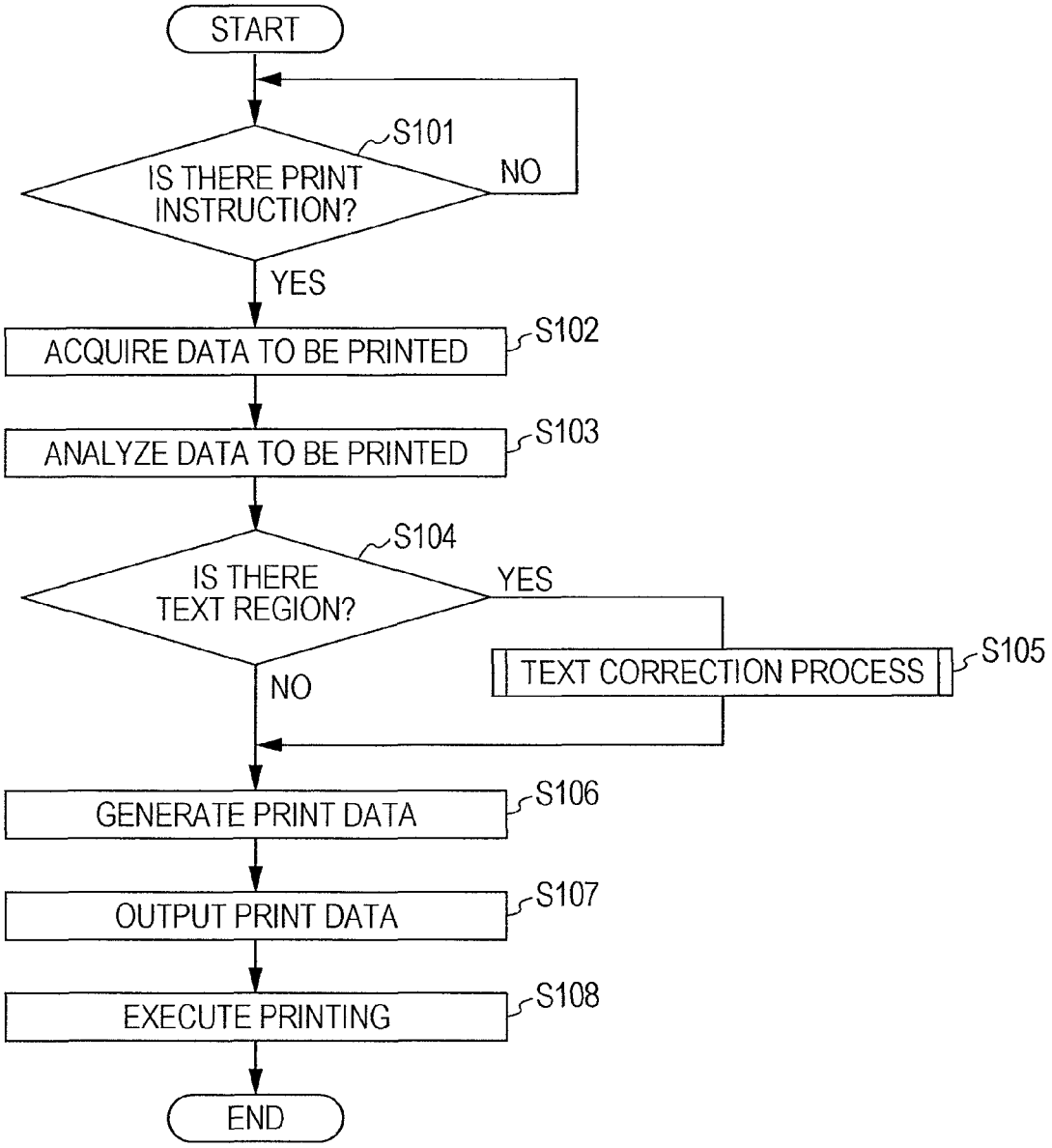
FIG. 9 is a flowchart of a printing process of the present embodiment.

FIG. 9 is a flowchart of a printing process of the present embodiment.

First, the controller 60 repeatedly determines whether there is a print instruction from the computer 110 (S101). If it is determined that there is a print instruction (YES of S101), the controller 60 acquires data to be printed (S102) and analyzes the data to be printed (S103). In detail, it is analyzed whether a region to be printed is any one of a text, a graphic or a photo and it is determined whether there is a text region in the region to be printed (S104).

If it is determined that there is a text region in the data to be printed (YES in S104), the controller 60 performs a text correction process (S105) and generates print data (S106). In addition, the details of the text correction process will be described later.

Meanwhile, in step S104, if it is determined that there is no text region in the data to be printed (NO in S104), print data is generated based on the data to be printed. In addition, the generated print data is output to the units (S107) and printing is executed (S108).

About the Text Correction Process

In the above-described flow of the printing process, if it is determined that there is a text region, the controller 60 performs the text correction process. In this text correction process, scanning is performed whether or not dots are formed in every pixel of the data to be printed. In addition, if dots are continuously formed by a predetermined length or more (for example, 10 dots or more) with a constant width (for example, 1 dot) and dots are not formed in the peripheral pixels thereof, it is determined that there is a ruled line. In the present embodiment, the printed ruled line is any one of the ruled line of the transportation direction or the ruled line of the paper width direction.

Figure 10:
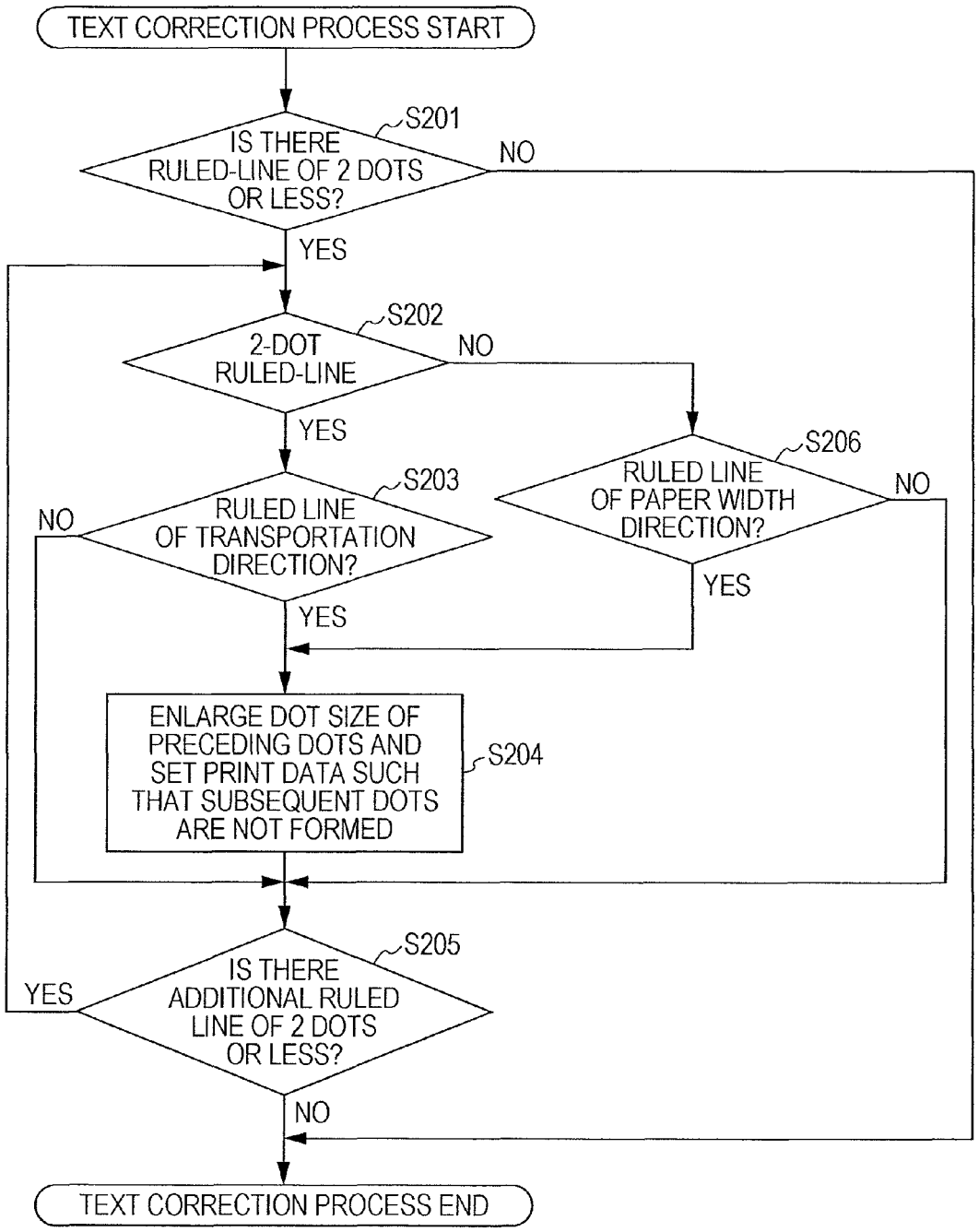
FIG. 10 is a flowchart of a text correction process of a first embodiment.
Figure 11:
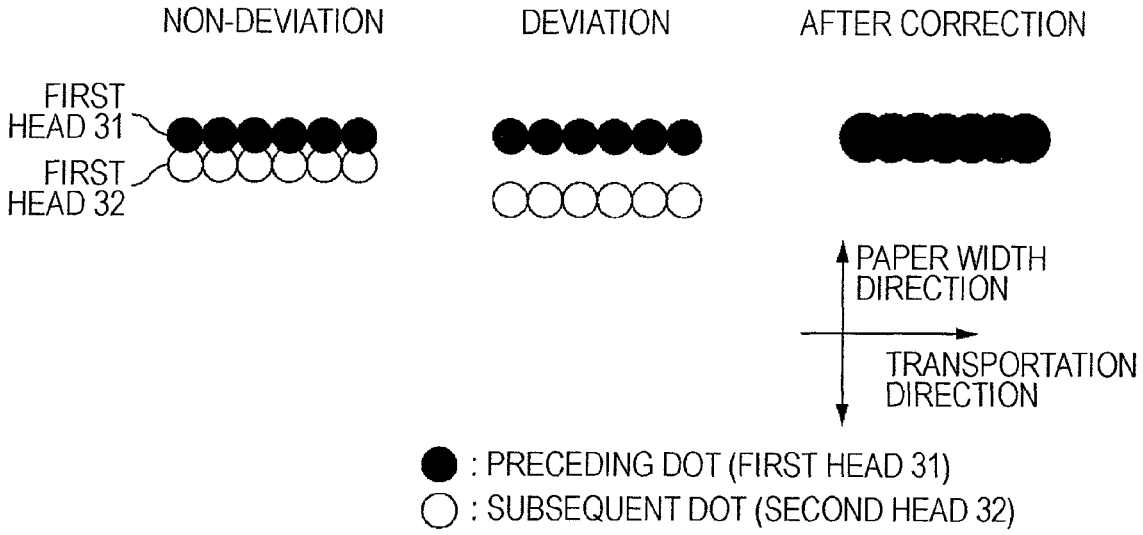
FIG. 11 is an explanatory view of the correction of a 2-dot ruled line.
Figure 12:
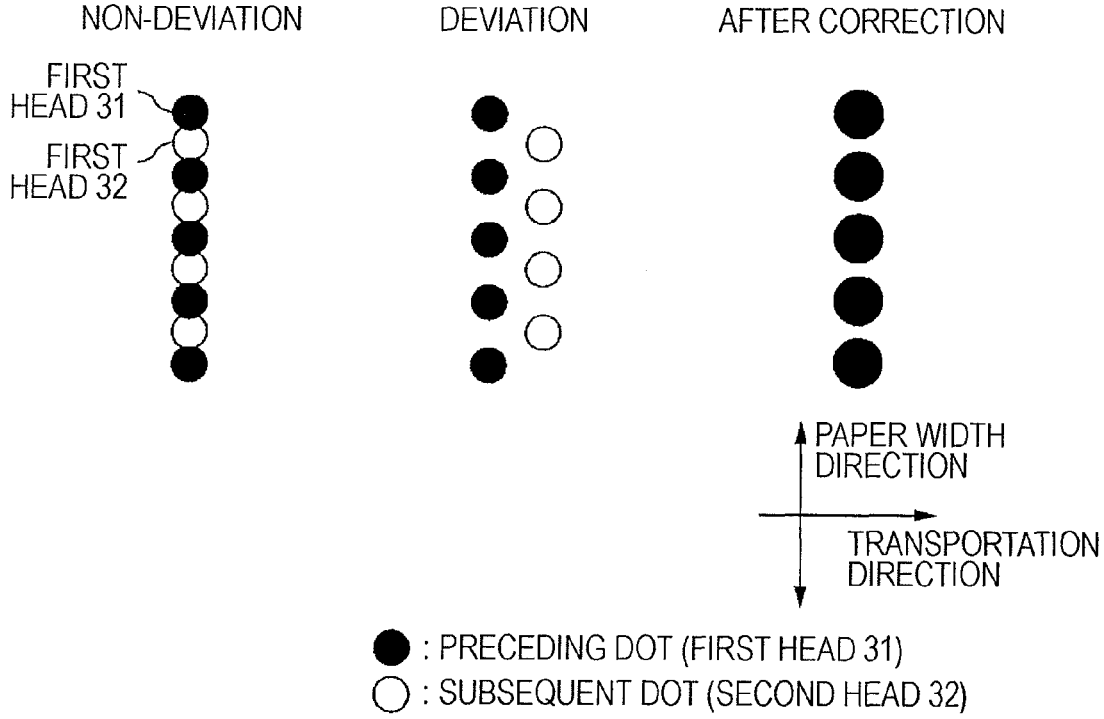
FIG. 12 is an explanatory view of the correction of a 1-dot ruled line.

FIG. 10 is a flowchart of a text correction process of a first embodiment. FIG. 11 is an explanatory view of the correction of a 2-dot ruled line. FIG. 12 is an explanatory view of the correction of a 1-dot ruled line. In FIGS. 11 and 12, a black circle denotes a dot (preceding dot) formed by the first head 31 and a white circle denotes a dot (subsequent dot) formed by the second head 32.

First, the controller 60 scans the data to be printed and determines whether there is a ruled line of 2 dots or less (S201). That is, it is determined whether there is a ruled line with a ruled-line width of 2 dots or 1 dot. If it is determined that there is no ruled lines of the linewidth of 2 dots or less (NO in S201), the text correction process is completed. If it is determined that there is a ruled line of the linewidth of 2 dots or less (YES in S201), the controller 60 determines whether the ruled line is a 2-dot ruled line (S202). If it is determined that the ruled line is the 2-dot ruled line, a text correction process for a 2-dot ruled line is executed and, if it is determined that the ruled line is not the 2-dot ruled line, a text correction process for a 1-dot ruled line is executed. First, the text correction process of the 2-dot ruled line will be described.

If it is determined that the ruled line is the 2-dot ruled line (YES in S202), the controller 60 determines whether the direction (hereinafter, referred to as a ruled-line direction) of the ruled line is the transportation direction (S203). That is, it is determined whether the direction of the ruled line is a direction perpendicular to the direction (paper width direction) of the nozzle arrays of the heads. As described with reference to FIG. 6, in the 2-dot ruled line of the transportation direction, the array (raster line) of the preceding dots is formed by any nozzle of the first head 31, and the array (raster line) of the subsequent dots is formed by any nozzle of the second head 32 (the left side of FIG. 11). Accordingly, when the landing positions of the inks of the nozzles are deviated in the paper width direction, as shown in the center of FIG. 11, the ruled line may be divided into two lines.

If it is determined that the ruled-line direction is the transportation direction (YES in S203), the controller 60 enlarges the dot size of the preceding dots (the dots formed by the first head 31) and changes the print data such that the subsequent dots (the dots formed by the second head 32) are not formed (S204). In other words, the ruled line is printed using only the preceding dots. In this way, as shown in the right side of FIG. 11, the ruled line of the transportation direction can be printed with a line width (line width close to the 2-dot ruled line) thicker than the 1-dot ruled line and without being divided, and image quality can be prevented from deteriorating.

Thereafter, the controller 60 determines whether there is an additional ruled line of 2 dots or less (S205). In step S203, if it is determined that the 2-dot ruled line is not the ruled line of the transportation direction (NO in S203), the ruled line is the ruled line of the paper width direction. As shown in FIG. 6, since there is only a low probability of the 2-dot ruled line of the paper width direction being divided due to the deviation of the landing positions of the inks by the heads, in this case, the controller 60 executes step S205 without correction.

Meanwhile, in step S202, if it is determined that the ruled line is not the 2-dot ruled line (NO in S202), that is, if it is determined that the ruled line is the 1-dot ruled line, the controller 60 determines whether the ruled-line direction is the paper width direction (S206). As described with reference to FIG. 5, in the 1-dot ruled line of the paper width direction, the preceding dots and the subsequent dots are alternately arranged so as to form the 1-dot ruled line (the left side of FIG. 12). Accordingly, if the landing positions of the inks ejected from the heads are deviated in the transportation direction, as shown in the center of FIG. 12, the ruled line may be divided into two lines.

If it is determined that the ruled-line direction is the paper width direction (YES in S206), the controller 60 enlarges the dot size of the preceding dots (the dots formed by the first head 31) and changes the print data such that the subsequent dots (the dots formed by the second head 32) are not formed (S205). In other words, the print data is changed such that the subsequent dots are thinned. In this way, as shown in the right side of FIG. 12, the 1-dot ruled line of the paper width direction is printed only by the nozzles of the first head 31. Accordingly, the ruled line (1-dot ruled line) of the paper width direction can be printed without being divided, and image quality can be prevented from deteriorating.

In step S206, if it is determined that the 2-dot ruled line is not the ruled line of the paper width direction (NO in S206), the ruled line is the ruled line of the transportation direction. As shown in FIG. 5, since the 1-dot ruled line of the transportation direction is formed only by one head, it is not affected by the influence of the deviation of the landing positions of the inks by the heads. Accordingly, in this case, the controller 60 executes step S205 without correction.

In step S205, if it is determined that there is an additional ruled line of 2 dots or less (YES in S205), the process returns to step S202 for determining whether the ruled line is the 2-dot ruled line. In contrast, in step S205, if it is determined that there is no additional ruled line of 2 dots or less (NO in S205), the text correction process is completed.

As described above, the influence of the deviation of the landing positions of the inks by the heads is different according to the kind of the ruled line (the ruled-line direction and the number of dots of the ruled-line width direction). In the present embodiment, when the ruled line is printed, it is determined whether or not correction is performed, according to the ruled-line direction and the number of dots of the ruled-line width direction. Accordingly, it is possible to efficiently prevent the deterioration of image quality of the ruled line which may be divided.

In addition, although, in the present embodiment, correction is performed in the 2-dot ruled line of the transportation direction and the 1-dot ruled line of the paper width direction, the cases requiring correction is different according to the print conditions (the dot size, resolution and the like) of the ruled line. For example, the case may be considered where the 3-dot ruled line of the paper width direction or the transportation direction of FIG. 7 is divided. Even in this case, correction may be performed similar to the above-described embodiment. That is, the dot size of the preceding dots may be enlarged such that the subsequent dots are not fowled. By performing correction, it is possible to prevent the ruled line from being divided with certainty and prevent image quality from deteriorating.

In the present embodiment, the preceding dots are enlarged such that the subsequent dots are not formed. Accordingly, it is possible to set the drying time of the printed image (ruled line) to be long. However, the invention is not limited thereto and the subsequent dots may be enlarged such that the preceding dots are not formed. Even in this case, it is possible to prevent the division of the ruled line with certainty.

Second Embodiment

A second embodiment is different from the first embodiment in the method of correcting the ruled line. In the second embodiment, the correction of the ruled line is performed according to the position on the paper S. This is because, when the paper S has shrunk, the shrinking direction is different according to the position on the paper S.

About the Shrinking of Paper S

Figure 13:
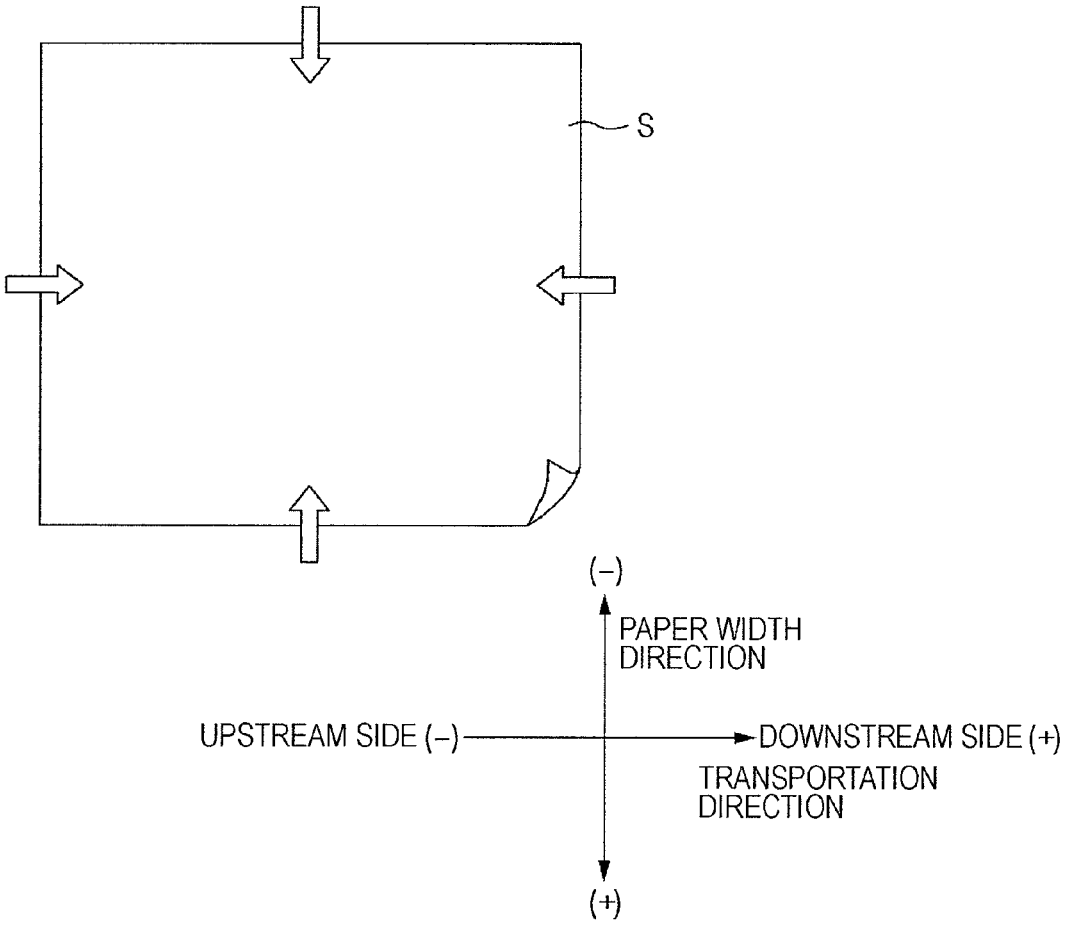
FIG. 13 is a schematic view showing a direction when paper S has shrunk.

FIG. 13 is a schematic view showing a direction when paper S has shrunk. As shown in FIG. 13, the paper S generally shrinks toward the center of the paper S. Accordingly, the shrinking amount is small in the central portion of the paper S and increases toward the edge of the paper S. With respect to the paper width direction, the upper half portion of the paper S is shrunk to the plus side (the down direction of the drawing) and the lower half portion thereof is shrunk to the minus side (the up direction of the drawing). With respect to the transportation direction, the upstream side of the center is shrunk to the plus side (the right direction of the drawing) and the downstream of the center is shrunk to the minus direction (the left direction of the drawing). The shrinking direction (deviation direction) is different according to the positions of the paper S. Accordingly, in the second embodiment, in consideration of the shrinking of the paper S, according to the positions of the paper S, the correction of the landing positions of the inks ejected from the nozzle arrays of the second head 32 is performed.

In the 2-dot ruled line of the transportation direction, as shown in FIG. 6, there are two types of ruled lines including a ruled line in which the preceding dots are positioned on the upper side and the subsequent dots are positioned on the lower side, and a ruled line in which the preceding dots are positioned on the lower side and the subsequent dots are positioned on the upper side. Accordingly, when the 2-dot ruled line of the transportation direction is printed, the necessity of the correction is different according to the shrinking direction of the paper S (the position on the paper S) and depending on whether the printed ruled line is either of the two kinds of ruled lines.

Figure 14:
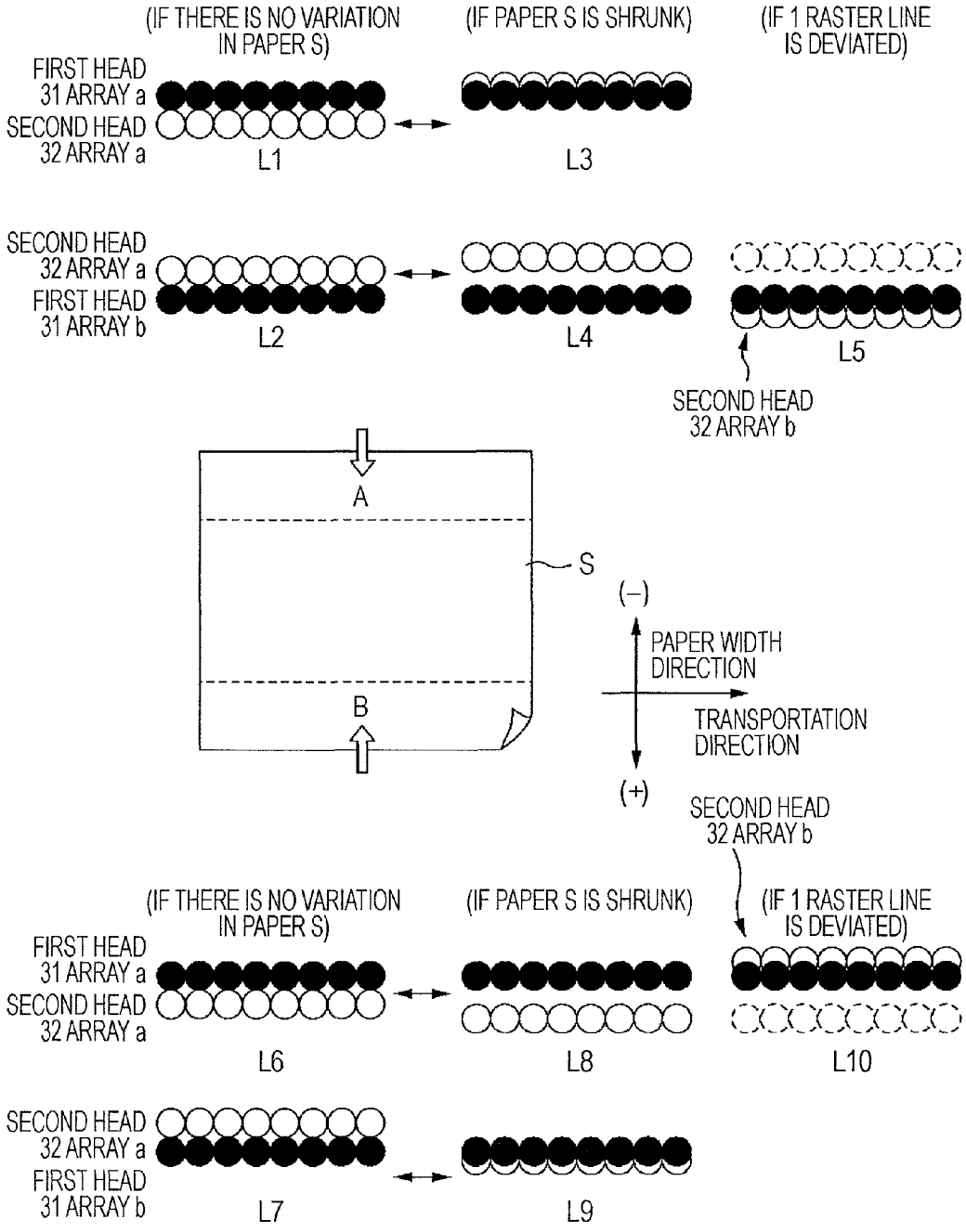
FIG. 14 is an explanatory view of the deviation of a 2-dot ruled line of a transportation direction and the position of paper S.

FIG. 14 is an explanatory view of the deviation of a 2-dot ruled line of a transportation direction and the position of paper S.

The upper side of the drawing shows the examples (L1 to L5) of the raster line when the 2-dot ruled line of the transportation direction is printed on the upper side (the region A of the drawing) of the paper S, and the lower side of the drawing shows the examples (L6 to L10) of the raster line when the 2-dot ruled line of the transportation direction is printed on the lower side (the region B of the drawing) of the paper S. In FIG. 14, the dot formed by the first head 31 is denoted by a black circle and the dot formed by the second head 32 is denoted by a white circle. In addition, the regions denoted by A and B in the paper S of the drawing are regions in which variation from the printing using the first head 31 to the printing using the second head 32 is equal to or more than a predetermined value (for example, 50 μm).

If it is assumed that there is no variation in the paper S, when the same arrays a of the first head 31 and the second head 32 are used, as denoted by L1 or L6 of the drawing, the dots formed by the second head 32 are positioned on the lower side of the dots formed by the first head 31. In other words, the later formed raster line is the 2-dot ruled line positioned on the lower side of the former formed raster line.

Meanwhile, if the first head 31 and the second head 32 use different arrays (the array a and the array b), as denoted by L2 or L7, the dots formed by the second head 32 are positioned on the upper side of the dots formed by the first head 31. In other words, the later formed raster line is the 2-dot ruled line positioned on the lower side of the former formed raster line.

Here, the paper S has shrunk in a direction denoted by an arrow of the drawing from the printing using the first head 31 to the printing using the second head 32. As described above, in the upper side (the region A of the drawing) of the paper S, the paper S has shrunk in the down direction (plus direction). Accordingly, in the region A, the landing position of the inks ejected by the second head 32 are deviated in the up direction. For example, if the paper S has shrunk when the ruled line of L2 is printed in the region A, since the raster line formed by the second head 32 is formed on the upper side of a desired position, the ruled line is divided into two lines as denoted by L4 of the drawing. Meanwhile, if the ruled line of L1 is printed in the region A, the raster line formed by the second head 32 is formed on the upper side of a desired position and thus the ruled line is, for example, similar to L3 of the drawing. In detail, the upper and lower positional relationship between the dots (raster lines) are reversed, but the raster lines form one ruled line without being divided.

In the upper side of the paper S, there is a higher probability of the ruled line being divided when the two heads use different arrays. That is, if the later formed raster line is positioned on the upper side (the opposite side of the shrinking direction) of the former foamed raster line, the ruled line may be divided.

In this case, the data of the array a of the second head 32 is moved to the next lower array b of the second head 32. In other words, the data of the ruled line corresponding to 2 raster lines of the transportation direction is deviated in the lower side (plus side) of the paper width direction of the drawing by 1 raster line. In this way, as denoted by L5 of the drawing, since the landing positions of the inks ejected from the second head 32 are corrected in the same direction as the shrinking direction of the paper S, it is unlikely that the ruled line will be divided. Accordingly, it is possible to prevent image quality from deteriorating.

In the lower side (for example, the region B of the drawing) of the paper S, the paper S has shrunk toward the up direction (minus direction). Accordingly, in the region B, the landing positions of the inks ejected from the second head 32 are deviated in the down direction. For example, if the paper S has shrunk when the ruled line of L6 is printed in the region B, since the raster line formed by the second head 32 is formed on the lower side of a desired position, the ruled line is divided into two lines as denoted by L8 of the drawing. Meanwhile, if the ruled line of L1 is printed in the region B, the raster line formed by the second head 32 is formed on the lower side of a desired position and thus the ruled line is, for example, L9 of the drawing. In detail, the upper and lower positional relationship between the dots (raster lines) are reversed, but the raster lines form one ruled line without being divided.

In the lower side of the paper S, there is a higher probability of the ruled line being divided when the two heads use the same array. That is, if the later formed raster line is positioned on the lower side (the opposite side of the shrinking direction) of the former formed raster line, the ruled line may be divided.

In this case, the data of the array a of the second head 32 is moved to the next higher array b of the second head 32. In other words, the data of the ruled line corresponding to 2 raster lines of the transportation direction is deviated in the upper side (minus side) of the paper width direction of the drawing by 1 raster line. In this way, as denoted by L10 of the drawing, since the landing positions of the inks ejected from the second head are corrected in the same direction as the shrinking direction of the paper S, it is unlikely that the ruled line will be divided. Accordingly, it is possible to prevent image quality from deteriorating.

About the Text Correction Process

Figure 15:
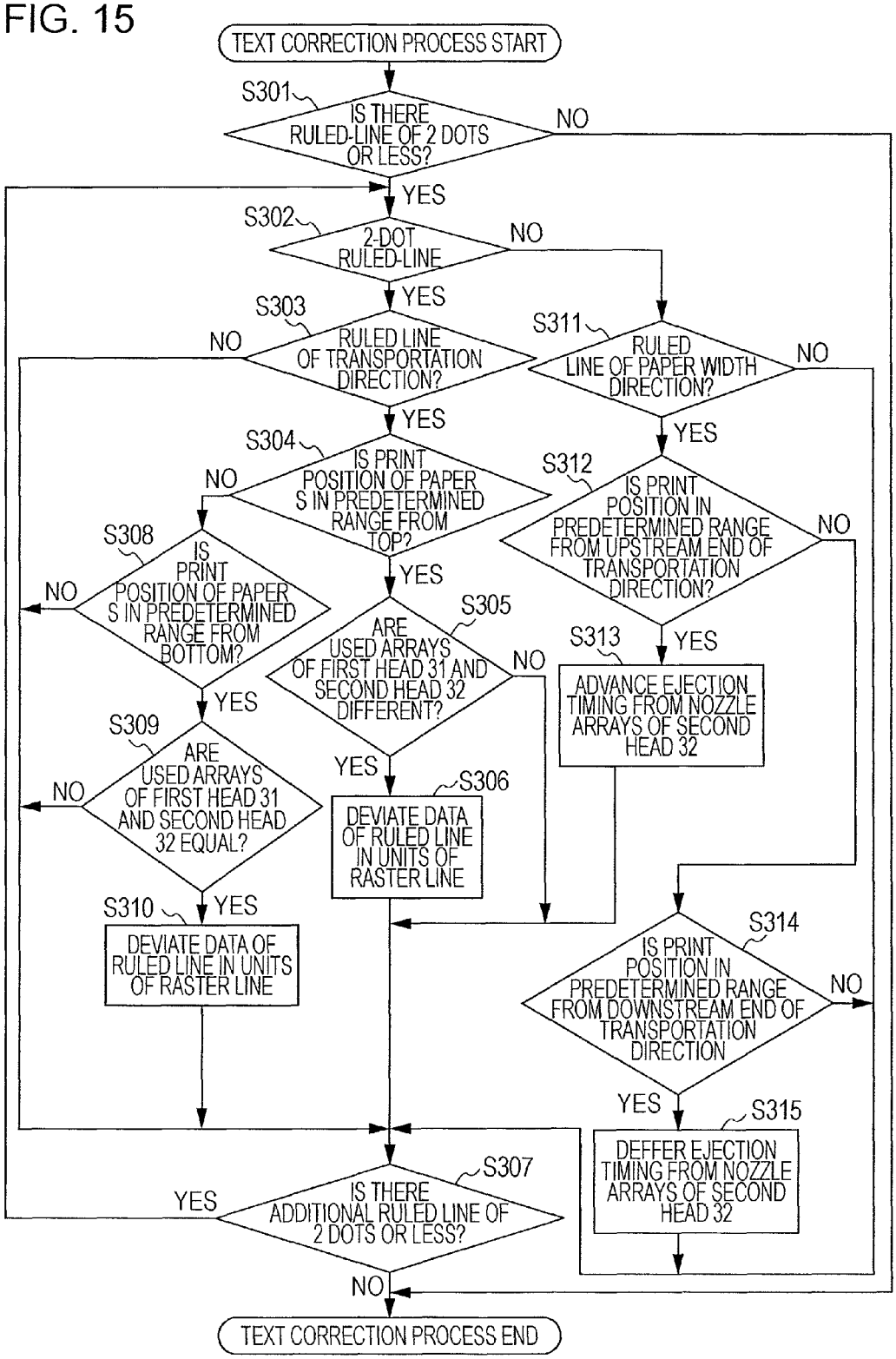
FIG. 15 is a flowchart of a text correction process of a second embodiment.

FIG. 15 is a flowchart of a text correction process of a second embodiment. In addition, FIGS. 13 and 14 are referred to in the following description.

First, the controller 60 scans the data to be printed and determines whether there is a ruled line of 2 dots or less (S301). That is, it is determined whether there is a ruled line with a ruled-line width of 2 dots or 1 dot. If it is determined that there is no ruled line of 2 dots or less (NO in S301), the text correction process is completed. If it is determined that there is a ruled line of 2 dots or less (YES in S301), it is determined whether the ruled line is a 2-dot ruled line (S302).

If it is determined that the ruled line is the 2-dot ruled line (YES in S302), the controller 60 executes the text correction process of the 2-dot ruled line of steps S303 to S310 and executes the text correction process of the 1-dot ruled line of steps S311 to S315 if the ruled line is not the 2-dot ruled line (NO in S302). First, the text correction process of the 2-dot ruled line will be described.

If it is determined that the ruled line is the 2-dot ruled line (YES in S302), the controller 60 determines whether the 2-dot ruled line is the ruled line of the transportation direction (S303). If it is determined that the 2-dot ruled line is the ruled line of the transportation direction (YES of S303), the correction process of the upper side of the paper S of steps S304 to S306 or the correction process of the lower side of the paper S of steps S308 to S310 is performed according to the print position of the ruled line.

If it is determined that the print position of the 2-dot ruled line on the paper S is in a predetermined range (the region A of FIG. 14) from the top (YES in S304), the controller 60 determines whether the arrays of the first head 31 and the second head 32 used for printing the ruled line are different (S305). That is, it is determined whether the subsequent dots are the ruled line of the upper side. As described above, in the upper side of the paper S, if the subsequent dots are the ruled line of the upper side, division is apt to occur due to deviation. Accordingly, if the arrays of the first head 31 and the second head 32 are equal (YES in S305), the correction of the landing positions of the subsequently dots (dots formed by the second head 32) is performed. For example, if the ruled line of L2 of FIG. 14 is printed, the data of the ruled line is changed such that the used nozzles of the second head 32 are the nozzles of the array b positioned just below the array a. In other words, the data of the ruled line corresponding to 2 raster lines is deviated to the plus side of the paper width direction by 1 raster line. In this way, the positions of the dots formed by the second head 32 are corrected in the shrinking direction (plus direction) of the paper as denoted by L5 of FIG. 14. Accordingly, since it is unlikely that the ruled line will be divided, it is possible to prevent image quality from deteriorating.

Thereafter, the controller 60 determines whether there is an additional ruled line of 2 dots or less (S307).

If it is determined that the print position of the 2-dot ruled line on the paper S is not in the predetermined range (the region A of FIG. 14) from the top in step S304 (NO in S304), the controller 60 determines whether the print position is in a predetermined range (the region B of FIG. 14) from the bottom of the paper S (S308). If it is determined that the print position of the 2-dot ruled line is in the predetermined range from the bottom of the paper S (YES in S308), it is determined whether the arrays of the first head 31 and the second head 32 used for printing the ruled line are equal (S309). That is, it is determined whether the subsequent dots are the ruled line of the lower side. As described above, in the lower side of the paper S, if the subsequent dots are the ruled line of the lower side, division is apt to occur due to deviation. Accordingly, if the arrays of the first head 31 and the second head 32 are equal (YES in S309), the correction of the landing positions of the subsequently dots (dots formed by the second head 32) is performed. For example, if the ruled line of L6 of FIG. 14 is printed, the data of the ruled line is changed such that the used nozzles of the second head 32 are the nozzles of the array b positioned just above the array a. In other words, the data of the ruled line corresponding to 2 raster lines is deviated to the minus side of the paper width direction by 1 raster line (S310). In this way, the positions of the dots formed by the second head 32 are corrected in the shrinking direction (minus direction) of the paper as denoted by L10 of FIG. 14. Accordingly, since it is unlikely that the ruled line will be divided, it is possible to prevent image quality from deteriorating.

Thereafter, the controller 60 determines whether there is an additional ruled line of 2 dots or less (S307).

If it is determined that the 2-dot ruled line is not the ruled line of the transportation direction in step s303 (NO in S303), the ruled line is the ruled line of the paper width direction. As described above, since the 2-dot ruled line of the paper width direction does not need to be corrected, step S307 of determining whether there is an additional ruled line of 2 dots or less is executed. In addition, if it is determined that the arrays of the first head and the second head are equal in step S305 (NO in S305), as shown in FIG. 14, in the upper side (for example, the region A) of the paper S, it is unlikely that the ruled line will be divided if the used arrays of the heads are equal. Accordingly, in this case, step S307 of determining whether there is an additional ruled line of 2 dots or less is executed without performing correction. If it is determined that the print position is not in the predetermined range from the bottom in step S308 (NO in S308), the print position of the ruled line is not included in the region A or the region B. Accordingly, since the ruled line is printed in a region in which variation in size of the paper S is small (a region in which a deviation is small), step S307 of determining whether there is an additional ruled line of 2 dots or less is executed without performing correction. In addition, if it is determined that the arrays of the first head and the second head are different in step S309 (NO in S309), as shown in FIG. 14, in the lower side (for example, the region B) of the paper S, it is unlikely that the ruled line will be divided if the used arrays of the heads are different. Accordingly, even in this case, step S307 of determining whether there is an additional ruled line of 2 dots or less is executed without performing correction.

Next, the text correction process of the 1-dot ruled line of steps S311 to S315 will be described. If it is determined that the ruled line is not the 2-dot ruled line in step S302 (NO in S302), the ruled line is the 1-dot ruled line. Then, the controller 60 first determines whether the direction of the ruled line is the paper width direction (S311). In addition, as described above, if the 1-dot ruled line is formed in the transportation direction, since only one head (one nozzle) is used, the ruled line is not affected by the deviation of the landing positions of the inks due to variation of the paper S. Accordingly, if it is determined that the direction of the ruled line is not the paper width direction in step S311 (NO in S311), that is, in the 1-dot ruled line of the transportation direction, step S307 of determining whether there is an additional ruled line of 2 dots or less is executed without performing correction.

If it is determined that the direction of the ruled line is the paper width direction in step S311 (NO in S311), the contents of the correction are changed according to the print position on the paper S.

First, the controller 60 determines whether the print position on the paper S is in a predetermined range from the upstream end of the transportation direction (S312). If the print position on the paper S is the upstream side of the transportation direction, the paper S is changed toward the downstream side (plus side) of the transportation direction as shown in FIG. 13. That is, the formation position of the preceding dots formed by the first head 31 is moved to the plus side. In other words, the formation position of the dots by the second head 32 is deviated to the minus side. Accordingly, if it is determined that the print position of the 1-dot ruled line on the paper S is in the predetermined range from the upstream end of the transportation direction (YES in S312), the controller 60 controls the head unit 30 so as to advance the ejection timing of the nozzle arrays of the second head 32. For example, the driving waveform of the driving signal is changed. In this way, since the landing positions of the inks by the second head 32 are moved to the downstream side (plus direction) of the transportation direction, it is unlikely that the ruled line will be divided and it is possible to prevent image quality of the 1-dot ruled line from deteriorating. Then, step S307 of determining whether there is an additional ruled line of 2 dots or less is executed.

Meanwhile, it is determined that the print position of the 1-dot ruled line on the paper S is not in the predetermined range from the upstream end of the transportation direction (NO in S312), the controller 60 determines whether the print position of the 1-dot ruled line on the paper S is in a predetermined range from the downstream end of the transportation direction (S314). If the print position on the paper S is the downstream side of the transportation direction, the paper S is changed toward the upstream side (minus side) of the transportation direction as shown in FIG. 13. That is, the formation position of the preceding dots formed by the first head 31 is moved to the minus side. In other words, the formation position of the dots by the second head 32 is deviated to the plus side. Accordingly, if it is determined that the print position of the 1-dot ruled line on the paper S is in the predetermined range from the downstream end of the transportation direction (YES in S314), the controller 60 controls the head unit 30 so as to defer the ejection timing of the nozzle arrays of the second head 32. For example, the driving waveform of the driving signal is changed. In this way, since the landing positions of the inks by the second head 32 are moved to the upstream side (minus direction) of the transportation direction, it is unlikely that divide the ruled line and it is possible to prevent image quality of the 1-dot ruled line from deteriorating.

If No in step S314, the print position of the 1-dot ruled line on the paper S is a region excluding the predetermined ranges of both ends of the transportation direction. Since variation in the paper S is small, the deviation amount is also small. Accordingly, in this case, step S307 of determining whether there is an additional ruled line of 2 dots or less is executed without performing the text correction process.

In step S307, if it is determined that there is an additional ruled line of 2 dots or less (YES in S307), the process returns to step S302, and the above-described process is performed again with respect to the ruled line.

Meanwhile, it is determined that there is no additional ruled line of 2 dots or less (No in S307), the text correction process is completed.

In the present embodiment, the landing positions of the inks ejected from the nozzles of the second head 32 are corrected according to the position of the paper S and the kind of the ruled line. Accordingly, even when the paper S has shrunk after printing is performed by the first head 31, the printing can be performed while the ruled line is not divided and the deterioration of image quality can be prevented.

Although, in the present embodiment, the landing positions of the inks by the second head 32 are corrected, the landing positions of the inks by the first head 31 may be corrected.

For example, if the ruled line (the preceding dots are the 2-dot ruled line of the lower side) of L2 is printed in the region A of the paper S of FIG. 14, the used nozzles of the array b of the first head 31 may be changed to the nozzles of the array a positioned just above the array b. That is, the data of the ruled line corresponding to 2 raster lines may be deviated to the minus side of the paper width direction by 1 raster line. In this case, since the positions of the dots formed by the first head 31 are corrected in the opposite direction (the same direction as the direction in which the dots formed by the second head 32 are deviated) of the shrinking direction of the paper S, it is unlikely that the ruled line will be divide similar to the case where the data is deviated to the plus side of the paper width direction by 1 raster line (L5 of FIG. 14).

Similarly, if the ruled line (the preceding dots are the 2-dot ruled line of the upper side) of L6 is printed in the region B of the paper S of FIG. 14, the used nozzles of the array a of the first head 31 may be changed to the nozzles of the array b positioned just below the array a. That is, the data of the ruled line corresponding to 2 raster lines may be deviated to the plus side of the paper width direction by 1 raster line. Even in this case, since the dots formed by the first head 31 are formed in the opposite direction (the same direction as the direction in which the dots formed by the second head 32 are deviated) to the shrinking direction of the paper S, it is unlikely that the ruled line will be divided similar to the case where the data is deviated to the minus side of the paper width direction by 1 raster line (L10 of FIG. 14).

Although, in step S313 of FIG. 15, the ejection timing of the nozzle arrays of the second head 32 is advanced, the ejection timing of the nozzle arrays of the first head 31 may be deferred. Similarly, although, in step S315, the ejection timing of the nozzle arrays of the second head 32 are deferred, the ejection timing of the nozzle arrays of the first head 31 may be advanced. In this way, the landing positions of the inks ejected from the first head 31 can be corrected in the opposite direction (the same direction as the direction in which the dots formed by the second head 32 are deviated) to the shrinking direction of the paper S. Accordingly, it is unlikely that the ruled line will be divided.

Third Embodiment

Although the region of the paper S, in which the text correction is performed, is previously set in the second embodiment, in a third embodiment, a ruled-line pattern with a plurality of ruled lines with different line widths in the paper width direction and the transportation direction is printed on the paper S and a region, in which the text correction is performed, is set based on the printed result.

Figure 16A:
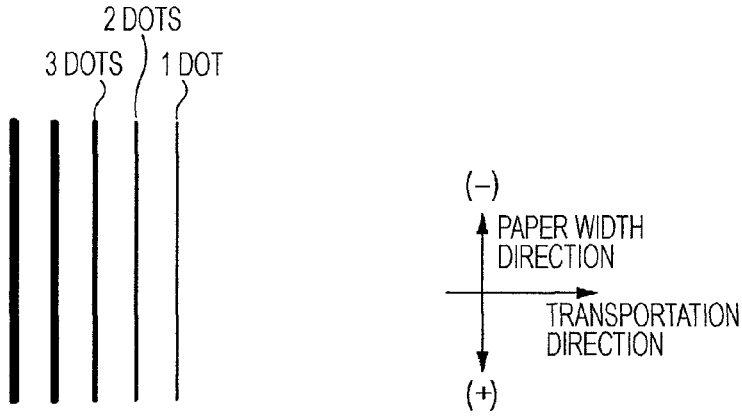
Figure 16B:
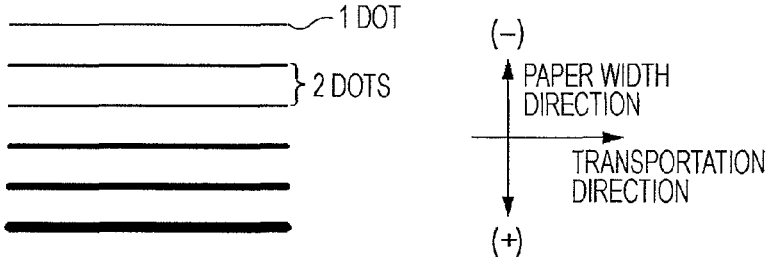

FIGS. 16A and 16B are examples of a ruled-line pattern, wherein FIG. 16A shows a ruled-line pattern in the paper width direction, and FIG. 16B shows a ruled-line patter in the transportation direction.

In each pattern, a plurality of ruled lines with different line widths is formed. For example, in the ruled line of the paper width direction shown in FIG. 16A, the ruled line of a right end is a 1-dot ruled line, a left adjacent ruled line thereof is a 2-dot ruled line, and a left adjacent ruled line thereof is a 3-dot ruled line. The number of dots of the line width direction increases and the ruled line is thickened toward the left side of the drawing.

In FIG. 16B, an uppermost ruled line is a 1-dot ruled line, and a lower ruled line thereof is a 2-dot ruled line. The 1-dot ruled line of the transportation direction is formed only by the first head 31 (or the second head 32), as shown in FIG. 5. In the 2-dot ruled line of the transportation direction, two kinds of ruled lines shown in FIG. 6 are printed. In detail, for example, the 2-dot ruled line of the upper side of FIG. 16B is the ruled line in which the raster line of the upper side (the minus side of the paper width direction) is formed by the first head 31 and the raster line of the lower side (the plus side of the paper width direction) is formed by the second head 32. The 2-dot ruled line of the lower side of the drawing is the ruled line in which the raster line of the upper side is formed by the second head 32 and the raster line of the lower side is formed by the first head 31.

The number of dots of the ruled-line width direction increases and the ruled line is thickened toward the lower side of the drawing.

While the number of 2-dot ruled lines of the transportation direction is two in FIG. 16B, the number of 2-dot ruled lines of the paper width direction is one in FIG. 16A. This is because, if the 2-dot ruled line of the paper width direction is formed, the dots formed by the first head 31 and the dots formed by the second head 32 are alternately formed in each of the raster lines of the paper width direction and, in this case, if the deviation amounts of the plus direction and the minus direction of the transportation direction are equal, the degree of deterioration of image quality is similar (see FIG. 6). That is, in the 2-dot ruled line of the paper width direction, the evaluation of the deviation (the deviation of the plus direction and the minus direction) of the transportation direction can be performed by one ruled line. The same is true in other ruled lines (for example, 1-dot ruled line) of the paper width direction.

Figure 17:
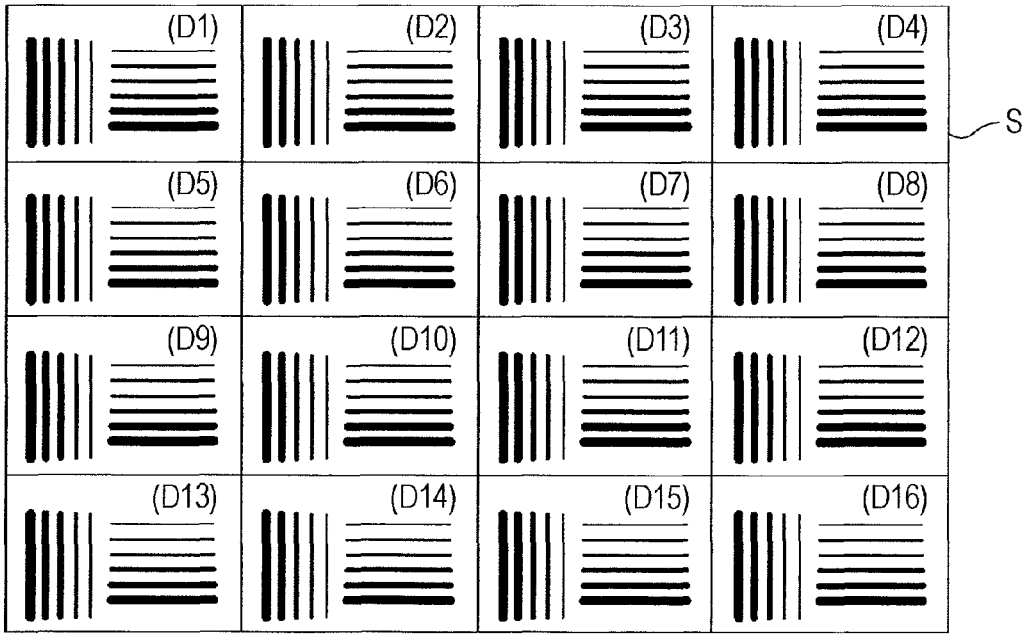
FIG. 17 is a view showing an example of an evaluation pattern.

FIG. 17 is a view showing an example of an evaluation pattern in which the ruled-line patterns of FIG. 16A and FIG. 16B are printed on the paper S. The ruled-line patterns of FIG. 16A and FIG. 16B are printed at a plurality of places of the paper S by the first head 31 and the second head 32. In the present embodiment, the paper S is divided into 4 regions in both a vertical direction and a horizontal direction so as to be divided into 16 regions, D1 to D16, and the ruled-line patterns of FIGS. 16A and 16B are printed in the regions. Accordingly, the presence/absence of the division of the ruled line of each of the ruled-line patterns can be confirmed in every region and every ruled line.

For example, if the paper S has shrunk such that there is a deviation of the paper width direction, as described above, the 2-dot ruled line of the transportation direction is apt to be divided. Since the paper S has shrunk toward the center thereof, in the upper side of the center of the paper width direction of the paper S, the positions of the dots (subsequent dots) formed by the second head 32 are deviated to the minus side of the paper width direction. Accordingly, by referring to FIG. 6, in the upper side of the paper S, of the two 2-dot ruled line of FIG. 16B, a ruled line in which the preceding dots are formed on the lower side (the 2-dot ruled line of the lower side of FIG. 16B) is apt to be divided. Accordingly, in the upper side of the paper S, the printed result of the 2-dot ruled line positioned on the lower side of the two 2-dot ruled lines is confirmed. A region in which the 2-dot ruled line is divided is specified based on the printed result of the test pattern, and the correction is applied to the region.

For example, in the regions D1 to D4 of the evaluation pattern, if the 2-dot ruled line of the lower side of FIG. 16B is divided, in step S304 of FIG. 15, it is determined whether the print position on the paper S is in the range of regions D1 to D4.

Meanwhile, in the lower side of the center of the paper width direction of the paper S, the positions of the dots (subsequent dots) formed by the second head 32 are deviated to the plus side of the paper width direction. Accordingly, by referring to FIG. 6, in the lower side of the paper S, of the two 2-dot ruled line of FIG. 16B, a ruled line in which the preceding dots are formed on the upper side (the 2-dot ruled line of the upper side of FIG. 16B) is apt to be divided. Accordingly, in the lower side of the paper S, the printed result of the 2-dot ruled line positioned on the upper side of the two 2-dot ruled lines is confirmed. A region in which the 2-dot ruled line is divided is specified based on the printed result, and the correction is applied to the region.

For example, in the regions D13 to D16 of the evaluation pattern, if the 2-dot ruled line of the upper side of FIG. 16B is divided, in step S308 of FIG. 15, it is determined whether the print position on the paper S is in the range of regions D13 to D16.

By the deviation of the transportation direction due to the shrinking of the paper S, as described above, the 1-dot ruled line of the paper of the paper width direction is apt to be divided. Since the paper S has shrunk toward the center thereof, the positions of the dots (subsequent dots) formed by the second head 32 are deviated to the upstream side (minus side) of the transportation direction in the left side (upstream side) of the center of the transportation direction of the paper S. Accordingly, if the 1-dot ruled line of the paper width direction is divided in the left side of the center of the transportation direction of the paper S, the left side of the divided ruled line is formed by the second head 32 and the right side thereof is formed by the first head 31 (see the deviation of the minus direction of FIG. 5).

Meanwhile, the positions of the dots (subsequent dots) formed by the second head 32 are deviated to the downstream side (plus side) of the transportation direction in the right side (downstream side) of the center of the transportation direction of the paper S. Accordingly, if the 1-dot ruled line of the paper width direction is divided in the right side of the center of the transportation direction of the paper S, the left side of the divided ruled line is formed by the first head 31 and the right side thereof is formed by the second head 32 (see the deviation of the plus direction of FIG. 5).

For example, in the regions D4, D8, D12 and D16 of the evaluation pattern, if the 1-dot ruled line of FIG. 16A is divided, in step S314 of FIG. 15, it is determined whether the print position on the paper S is in the range of the regions D4, D8, D12 and D16. In the regions D1, D5, D9 and D13, if the 1-dot ruled line of FIG. 16A is divided, in step S312 of FIG. 15, it is determined whether the print position on the paper S is in the range of the regions D1, D5, D9 and D13.

In the third embodiment, based on the print result of the ruled-line pattern, the correction is determined according to the position on the paper S and the kind of the ruled line. Accordingly, it is possible to more accurately perform the correction of the ruled line according to the position on the paper S.

The same correction as the first embodiment may be performed according to the position on the paper S. For example, if the 2-dot ruled line of the transportation direction printed in the region in which the evaluation pattern of FIG. 17 is present is divided, when the 2-dot ruled line of the transportation direction is printed in the region, correction (see FIG. 11) may be performed such that the preceding dots are formed to be large and the subsequent dots are not formed. Even in the region in which the 1-dot ruled line of the paper width direction is divided, similarly, correction (see FIG. 12) may be performed such that the preceding dots are formed to be large and the subsequent dots are not formed.

Other Embodiments

The above-described embodiments are to facilitate the understanding of the invention, is not intended to limit and analyze the invention. The invention may be modified or changed without departing from the scope of the invention and the invention includes the equivalent thereof. In particular, the invention includes the following embodiments.

About the Printer 1

Although, in the above-described embodiments, a line head printer in which the nozzles are lined up in the paper width direction perpendicular to the transportation direction of the medium is described, the invention is not limited thereto. For example, a printer may be used which alternately repeating a dot formation operation for forming dot arrays according to a movement direction and a transportation operation (movement operation) for transporting paper in a transportation direction which is a nozzle array direction, while moving a head unit in the movement direction perpendicular to the nozzle array direction.

Although, in the above-described embodiment, the ink jet printer for ejecting ink which is an example of the liquid is described, a liquid ejecting apparatus for ejecting other liquids excluding ink is applicable. For example, a printing device for attaching a pattern on fabric, a display manufacturing device such as an organic EL display or a color filter manufacturing device, a DNA chip manufacturing device for coating a chip with a solution, in which DNA is dissolved, and manufacturing a DNA chip, or a circuit board manufacturing device is applicable. In addition, as an ink ejecting method for ejecting ink from nozzles of the printer 1, a piezoelectric method for expanding and contracting an ink chamber by driving a piezoelectric element or a thermal method for generating bubbles in nozzles using a heating element and ejecting ink by the bubbles may be used.

Although, in FIG. 3, the nozzle pitch between the nozzles of the first head 31 and the nozzles of the second head 32 is deviated by half of the nozzle pitch between the nozzles of the first head 31 or the nozzle pitch between the nozzles of the second head 32 in the paper width direction, the nozzles of the first head 31 and the nozzles of the second head 32 may be aligned in the paper width direction. In this case, for example, out of the K nozzles (the nozzles of the nozzle array a and the nozzle array b) of the first head 31, every other nozzle is used in the paper width direction and, out of the K nozzles of the nozzles of the second head 32, every other nozzle is used in the paper width direction. The used nozzles of the K nozzles of the first head 31 and the used nozzles of the K nozzles of the second head 32 are the nozzles which are positioned at different positions in the paper width direction, or the used nozzles of the K nozzles of the first head 31 and the used nozzles of the K nozzles of the second head 32 are nozzles which are positioned at different positions in the paper width direction.

About the Drying Mechanism

The drying mechanism 41 can dry the medium and, for example, a device for applying an active energy line such as hot air, infrared ray, UV, microwave wave may be used.

The drying mechanism 41 may not be provided, and the paper S may be naturally dried after the printing using the first head 31 and before the printing using the second head 32. In this case, since the drying mechanism 41 is not used, it is possible to reduce printing cost.

What is claimed is:

1. A method of printing on a medium for ruled line correction, wherein a ruled line is a line comprising a length disposed along either a length or a width direction of the medium, and a width of either one or two pixels, the method comprising:

(a) acquiring data that corresponds to an image to be printed on the medium;

(b) determining whether the image comprises any ruled line;

(c) if the image does not comprise any ruled line, proceeding to step (h);

(d) if the image does comprise a ruled line, determining a length direction of the ruled line relative to the medium, and determining a width of the ruled line;

(e) if the image does comprise a ruled line, either (f) immediately returning to step (b) to determine whether the image comprises an additional ruled line, or (g) performing a correction method on the ruled line, wherein the correction method comprises altering at least one of a size or an existence of at least one pixel of the ruled line, and returning to step (b) to determine whether the image comprises an additional ruled line;

wherein step (e) selects either step (f) or step (g) based on the length direction of the ruled line relative to the medium and based on the width of the ruled line; and (h) printing the image and ending the method.

2. The method of claim 1, wherein:

step (e) selects step (g) if the ruled line is:

(i) a ruled line comprising a length disposed along a length direction of the medium and a width of exactly two pixels; or (ii) a ruled line comprising a length disposed along a width direction of the medium and a width of exactly one pixel; and step (e) selects step (f) if the ruled line is neither (i) nor (ii).

3. The method of claim 1, further comprising, subsequent to step (a):

determining whether or not the image comprises a text region;

if the image does not comprise a text region, proceeding to step (h); and if the image does comprise a text region, proceeding to step (b).

4. The method of claim 1, wherein a ruled line further comprises a length of at least a certain amount and no dots formed in peripheral pixels thereof.

5. The method of claim 4, wherein the certain amount is ten pixels.

6. The method of claim 1, wherein printing the image is performed on a printing apparatus comprising a first and a second nozzle array, wherein altering the size or the existence of at the least one pixel of the ruled line comprises printing comparatively large dots with the first nozzle array and not printing with the second nozzle array.

7. The method of claim 6, wherein the first nozzle array prints prior to the second nozzle array.

8. The method of claim 6, wherein the first nozzle array is a first print head, and the second nozzle array is a second print head.

9. The method of claim 1, wherein the correction method varies depending on a position of the ruled line on the medium.

* * * * *